US012497776B2

(12) United States Patent
Sudeith et al.

(10) Patent No.: US 12,497,776 B2
(45) Date of Patent: Dec. 16, 2025

(54) CLIMBING WALL ASSEMBLIES

(71) Applicant: Everlast Climbing Industries, Inc., Crystal, MN (US)

(72) Inventors: Timothy Shawn Sudeith, Edina, MN (US); Sarah Mae Howard, Lakeville, MN (US); Joel Greenblatt, Wauwatosa, WI (US); Joseph Sweeney, Minneapolis, MN (US)

(73) Assignee: EVERLAST CLIMBING INDUSTRIES, INC., Crystal, MN (US)

( * ) Notice: Subject to any disclaimer, the term of this patent is extended or adjusted under 35 U.S.C. 154(b) by 145 days.

(21) Appl. No.: 17/979,446

(22) Filed: Nov. 2, 2022

(65) Prior Publication Data

US 2023/0052336 A1 Feb. 16, 2023

Related U.S. Application Data

(63) Continuation of application No. 16/856,279, filed on Apr. 23, 2020, now Pat. No. 11,525,262, which is a (Continued)

(51) Int. Cl.
*A63B 69/00* (2006.01)
*E04B 1/19* (2006.01)

(Continued)

(52) U.S. Cl.
CPC ..... *E04C 3/005* (2013.01); *E04B 1/19* (2013.01); *E04B 2/56* (2013.01); *E04G 11/065* (2013.01);

(Continued)

(58) Field of Classification Search
CPC ..... A63B 69/0048; A63B 2225/09; E04G 11/065; E04G 25/061; E04G 11/56;

(Continued)

(56) References Cited

U.S. PATENT DOCUMENTS 2,665,950 A 1/1954 Johnson
3,356,330 A 12/1967 Rambelle (Continued)

FOREIGN PATENT DOCUMENTS

DE 2657123 9/1977
EP 0384439 8/1990

(Continued)

OTHER PUBLICATIONS https://gallaghercorp.com/polyurethane-durometer-hardness Polyurethane hardness 2025.*

*Primary Examiner* — Adriana Figueroa
(74) *Attorney, Agent, or Firm* — McAndrews, Held & Malloy, Ltd.

(57) ABSTRACT

The present disclosure is directed to climbing wall assemblies having a variety of improvements. For instance, the climbing wall assemblies may include connectors to attach the surface panels to the framework, in which the connectors may be mounted substantially anywhere along the front of the framework and at substantially any angle, providing for the securement of climbing panels in various geometries. The climbing wall assemblies may also include braces that may easily be adjusted to a desired length and configuration during construction of a climbing wall. The climbing wall assemblies may also include variable-angle, integral front posts, which provide for the easy and stable securement of climbing panels in various geometries. These improvements provide climbing wall assemblies that may be easily assembled to produce a desirable climbing wall structure having few framework components.

19 Claims, 23 Drawing Sheets

Related U.S. Application Data continuation of application No. 16/045,200, filed on Jul. 25, 2018, now Pat. No. 10,669,717.

(60) Provisional application No. 62/598,694, filed on Dec. 14, 2017, provisional application No. 62/536,841, filed on Jul. 25, 2017.

(51) Int. Cl.

| | |
|---|---|
| ***E04B 2/56*** | (2006.01) |
| ***E04C 3/00*** | (2006.01) |
| ***E04G 11/06*** | (2006.01) |
| ***E04G 25/06*** | (2006.01) |
| *E04B 1/343* | (2006.01) |
| *E04B 1/348* | (2006.01) |
| *E04C 3/04* | (2006.01) |
| *E04G 11/56* | (2006.01) |
| *E04H 3/14* | (2006.01) |

(52) U.S. Cl.
CPC ..... *E04G 25/061* (2013.01); *A63B 69/0048* (2013.01); *A63B 2209/00* (2013.01); *A63B 2225/09* (2013.01); *E04B 1/34305* (2013.01); *E04B 1/3483* (2013.01); *E04C 2003/0486* (2013.01); *E04G 11/56* (2013.01); *E04H 3/14* (2013.01)

(58) Field of Classification Search
CPC ..... E04B 2/56; E04B 1/19; E04B 1/34305; E04B 1/3483; E04C 3/005; E04C 2003/0486
See application file for complete search history.

(56) References Cited

U.S. PATENT DOCUMENTS

| | | | | |
|---|---|---|---|---|
| 3,874,625 | A | 4/1975 | Hansen et al. | |
| 3,902,931 | A | 9/1975 | Danciger et al. | |
| 3,942,904 | A | 3/1976 | Morris | |
| 4,658,560 | A | 4/1987 | Beaulieu | |
| 4,682,772 | A | 7/1987 | Skaika | |
| 5,105,598 | A | 4/1992 | Wilcox | |
| 5,254,058 | A | 10/1993 | Savigny | |
| 5,941,041 | A | 8/1999 | Robinson et al. | |
| 6,431,794 | B1 | 8/2002 | Zweber | |
| 6,514,178 | B2 | 2/2003 | Vettori | |
| 6,758,448 | B1 | 7/2004 | Williams et al. | |
| 7,572,207 | B2 * | 8/2009 | Postma | A63B 69/0048 482/37 |
| 7,762,928 | B2 | 7/2010 | Meissner | |
| 8,951,166 | B2 | 2/2015 | Bae | |
| 9,034,454 | B1 * | 5/2015 | Bowman | E02B 3/16 405/116 |
| 9,103,090 | B2 | 8/2015 | Bushore | |
| 9,545,555 | B2 | 1/2017 | Sudeith et al. | |
| 2005/0287293 | A1 * | 12/2005 | Rothman | C04B 41/63 427/372.2 |
| 2016/0185268 | A1 * | 6/2016 | Nachtman | B60R 13/01 296/26.02 |

FOREIGN PATENT DOCUMENTS

| | | |
|---|---|---|
| EP | 2926873 | 10/2015 |
| FR | 2678515 | 1/1993 |
| FR | 2695040 | 3/1994 |
| GB | 898942 | 6/1962 |
| GB | 1229575 | 4/1971 |
| KR | 101239128 | 3/2013 |
| WO | 02081037 | 10/2002 |

* cited by examiner

CLIMBING WALL ASSEMBLIES

This application is a continuation of U.S. Nonprovisional patent application Ser. No. 16/856,279, filed on Apr. 23, 2020, which is a continuation of U.S. Nonprovisional patent application Ser. No. 16/045,200, filed on Jul. 25, 2018 and granted as U.S. Pat. No. 10,669,717 B2, which claims priority to both U.S. Provisional Patent Application No. 62/536,841, filed on Jul. 25, 2017, and U.S. Provisional Patent Application No. 62/598,694, filed on Dec. 14, 2017. The entirety of each of the aforementioned patent applications is incorporated herein by reference.

BACKGROUND

A complex climbing wall, such as one that provides a variety of climbing planes, typically requires a time-consuming and expensive installation process, in which the often complex truss assembly that provide a stable framework onto which the surface panels are affixed must be constructed on-site. Construction of the truss assembly typically involves the proper assembly of a large number of components and the welding of the components together to form the truss assembly. Additionally, complex climbing walls are typically assembled using components which must be either be specially designed or cut on-site to the exact specifications necessary for the specific climbing wall design. Accordingly, the construction of a complex climbing wall can be an expensive and time-consuming process.

Moreover, the complexity of the truss assembly places a number of limitations on the climbing wall. For instance, the number and variety of climbing planes that can be formed by the surface panels may be limited by the geometry of the truss assembly, which is typically formed from straight components. Similarly, the placement of hand holds may be limited by the metal substructures that underlie the surface panels for structural support. Further, the surface panels must themselves be cut to very specific dimensions so as to fit tightly together where they intersect to create different climbing planes.

For all of these reasons, once a complex climbing wall is constructed, it is rarely, if ever, altered. Indeed, any sort of adjustment of the climbing surface would typically require a significant, if not complete, rebuild of the entire climbing wall assembly.

SUMMARY OF THE INVENTION

Embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and braces. The one or more surface panels are affixed to the front posts by a plurality of connectors. At least one of the connectors may comprise a buffer, which is affixed to the backside of the surface panel, and a securing bracket, which is affixed to one of the front posts of the framework.

Embodiments of the connectors disclosed herein provide a number of advantages. For instance, the buffer may be made of a relatively soft material, such as wood, that does not prevent the mounting of a climbing grip on the surface panel at a position directly opposite the buffer. The securing bracket may be configured to be affixed to the front post at substantially any location along its length. The securing bracket may also be configured to extend from the front post at substantially any position around its circumference. Finally, the connector may be configured so that the distance between the buffer and the securing bracket may be adjustable. These features provide the connectors disclosed herein with versatility unknown in the field. For example, embodiments of the connectors disclosed herein may be mounted substantially anywhere along the front of the framework and at substantially any angle, allowing for the securement of climbing panels in various new geometries, including for example curved climbing panels.

Additional embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and a plurality of braces. At least one of the braces may be an adjustable brace, i.e. a brace having an adjustable length.

Embodiments of the adjustable braces disclosed herein provide a number of advantages. Some embodiments comprise a first mounting plate at a first end of the brace and a second mounting plate at a second end of the brace, wherein the first mounting plate and the second plate may be positioned either parallel with one another or perpendicular to one another. This may be achieved, for example, by providing an inner element and an outer element that are rotatable at least 90° relative to one another. The length of the brace may also be adjusted by providing an inner element and an outer element, wherein a portion of the inner element is received within the outer element and a portion of the inner element extends from the outer element, and where the inner element is slidable relative to the outer element, such that the length of the portion of the inner element that extends from the outer element may be adjusted by simply sliding the inner element until a desired length is reached. These features provide the braces disclosed herein with versatility unknown in the field. For example, embodiments of the braces disclosed herein may be used throughout a truss assembly and each may easily be adjusted to a desirable configuration on-site during construction of a climbing wall.

Additional embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and braces. At least one of the front posts may be a variable-angle, integral front post that includes at least a first portion that extends at a first angle relative to a vertical axis and a second portion that extends at a second, different angle relative to the vertical axis.

Embodiments of the variable-angle integral front posts disclosed herein provide a number of advantages. In some embodiments, the variable-angle, integral front posts may include one or more portions that extend vertically, one or more portions that are inclined inward, and/or one or more portions that are inclined outward. Surface panels may be affixed to the various portions of the variable-angle, integral front posts, such that the surface panels are positioned at a variety of angles along the length of the front post. The variable-angle, integral front posts disclosed herein provide versatility unknown in the field. For example, embodiments of the variable-angle, integral front posts allow for the easy and stable securement of climbing panels in various geometries using few components.

Additional embodiments of the present disclosure are directed to a climbing wall comprising a framework, or truss assembly, a plurality of surface panels affixed to the framework to provide a climbing surface, and a plurality of climbing holds arranged along the plurality of surface panels. The framework provides structural support for the climbing wall and includes at least front posts, support posts, and braces. At least two of the adjacent surface panels may comprise rounded edges that contact one another to form a joint.

Embodiments of the rounded-edge surface panels disclosed herein allow for the angle between adjacent surface panels to be adjusted by rotation of the rounded edge of one surface panel about the rounded edge of the other surface panel. No mitering or beveling is required to achieve a tight joint. Moreover, any gap at the intersection between adjacent panels does not need to be filled because the rounded edges do not pose any safety hazards. The rounded-edge surface panels disclosed herein provide an increased ease and versatility to the mounting of surface panels to prepare a climbing surface having various climbing planes.

Additional embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and braces. At least one of the one or more surface panels may have a textured surface that is substantially transparent.

Embodiments of the surface panels disclosed herein may comprise an aggregate (to provide texture) dispersed in a substantially transparent matrix. For example, one or more of the surface panels may comprise glass beads, crushed glass, a light-transmitting silica sand or a natural granular material dispersed in a substantially transparent polymeric matrix. The layer or substructure underlying the textured surface may thus be visible underneath the plurality of climbing holds, yet the climbing surface may provide a desired texture. Embodiments of the surface panels disclosed herein allow for the preparation of various custom climbing walls.

Additional embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and braces. At least one of the one or more surface panels may comprise a flexible polymeric surface coating, such as a flexible polymeric surface coating that has been applied through an industrial spraying process.

Additional embodiments of the present disclosure are directed to a climbing wall comprising a framework, or truss assembly, one or more surface panels affixed to the framework to provide a climbing surface, and a plurality of climbing holds arranged along the one or more surface panels. The framework provides structural support for the climbing wall and includes at least front posts, support posts, and braces. At least one of the one or more surface panels may comprise a surface coating comprising at least a first layer comprising a texturing component, and a second layer covering the first layer and sealing the texturing component in place. In some embodiments, the second layer may comprise a non-stick component.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
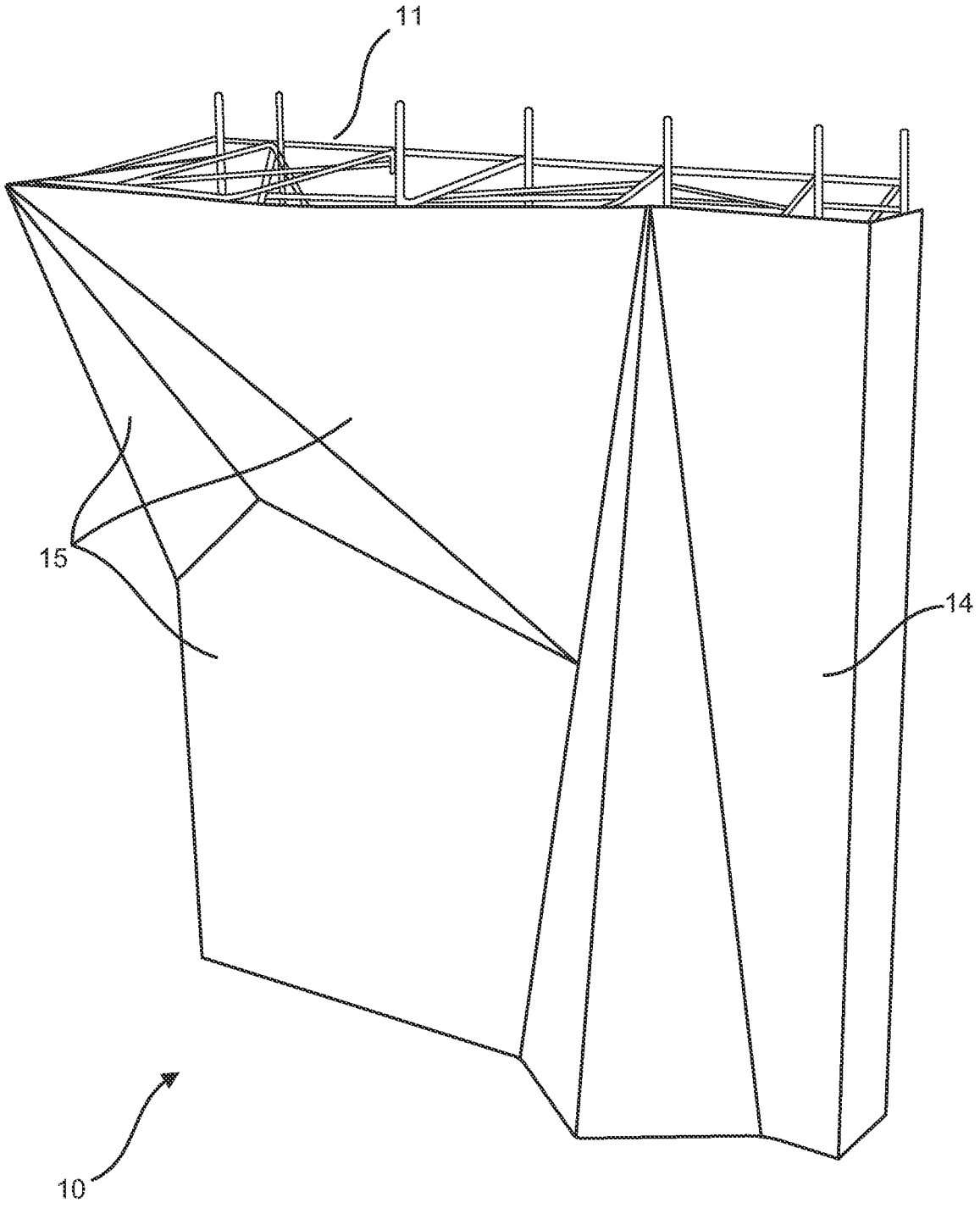
FIG. 1 is a front perspective view of an embodiment of a climbing wall comprising a plurality of surface panels mounted to a complex framework.

Embodiments of the present disclosure are directed to climbing walls 10 having any of a variety of improved components and elements. At a basic level, the climbing walls 10 disclosed herein comprise a framework 11, one or more surface panels 12 affixed to the framework, and a plurality of climbing holds 13 arranged along the one or more surface panels. Together, the surface panels 12 and the climbing holds 13 provide a climbing surface 14. In some embodiments, the climbing wall 10 may be a complex climbing wall, in which the climbing surface 14 comprises a plurality (i.e., two or more) of different climbing planes 15. An example of a complex climbing wall 10 in which the climbing surface 14 comprises a variety of different climbing planes 15 is shown in FIG. 1.

Figure 2:
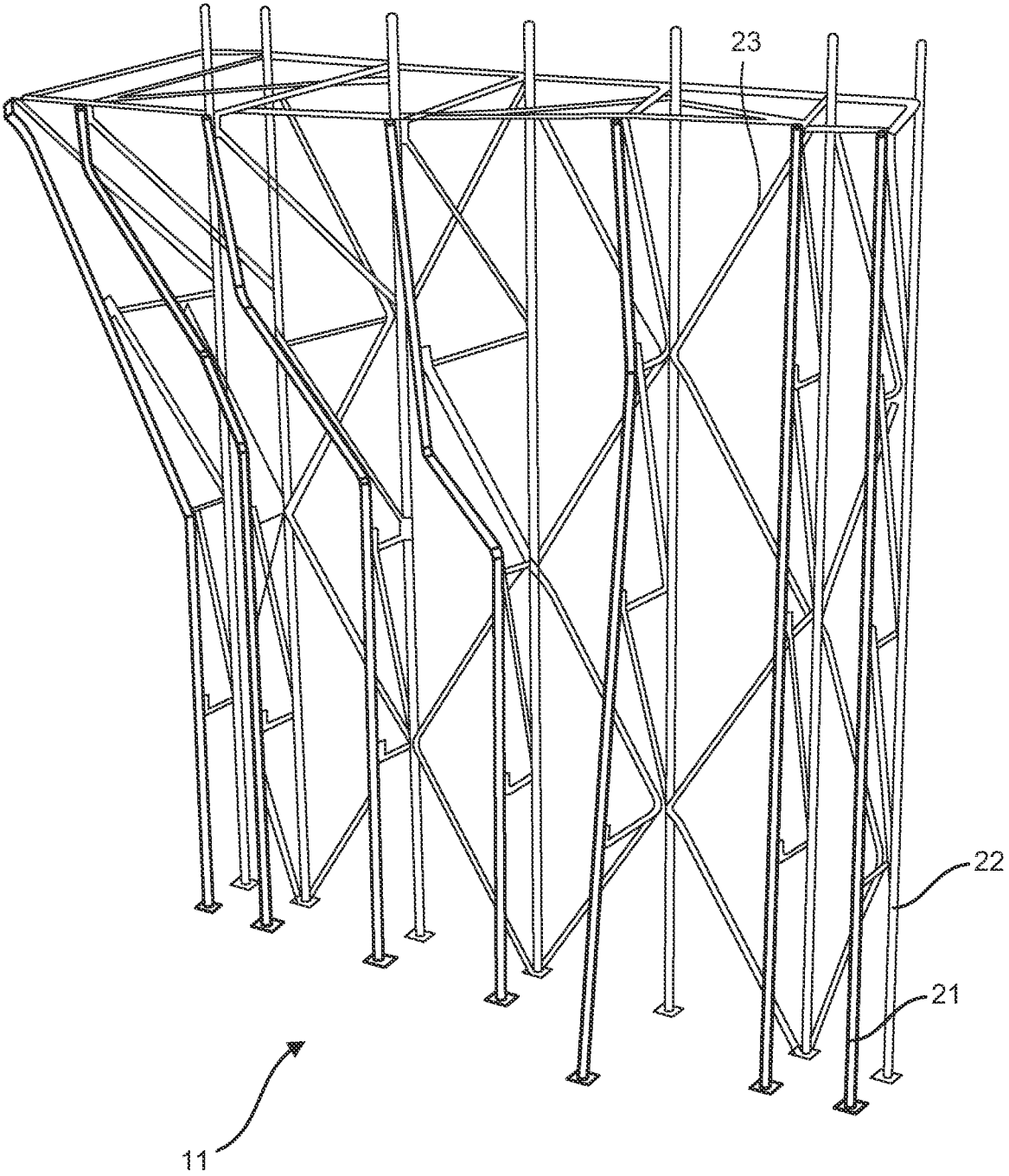
FIG. 2 is a front perspective view of the framework, or truss assembly, of the embodiment of a climbing wall shown in FIG. 1.

The framework 11, also known as the truss assembly, of the climbing wall 10 comprises a combination of front posts 21, support posts 22, and braces 23. Typically, the surface panels 12 are affixed to the front of the front posts 21 and the support posts 22 are positioned behind the front posts. Each front post 21 is typically connected to one or more support posts 22 by a plurality of braces 23. Additionally, braces 23 can be used to connect each support post 22 to one or more adjacent support posts. In some embodiments, braces 23 can also be used to connect each front post 21 to one or more adjacent front posts. An example of a framework 11 for a complex climbing wall 10 is shown in FIG. 2.

Figure 3:
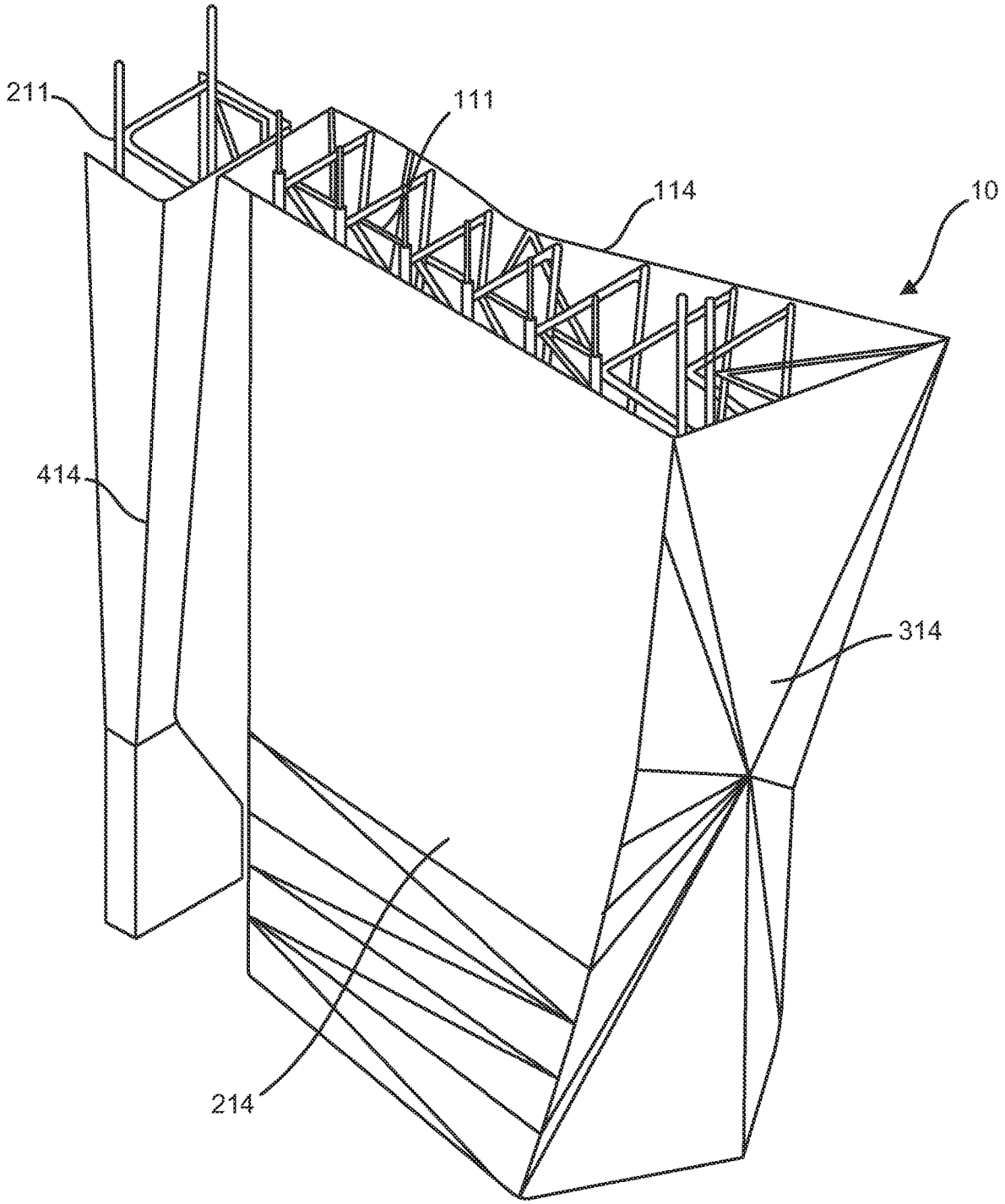
FIG. 3 is a rear perspective view of an embodiment of a climbing wall comprising a plurality of surface panels mounted to a complex framework.
Figure 4:
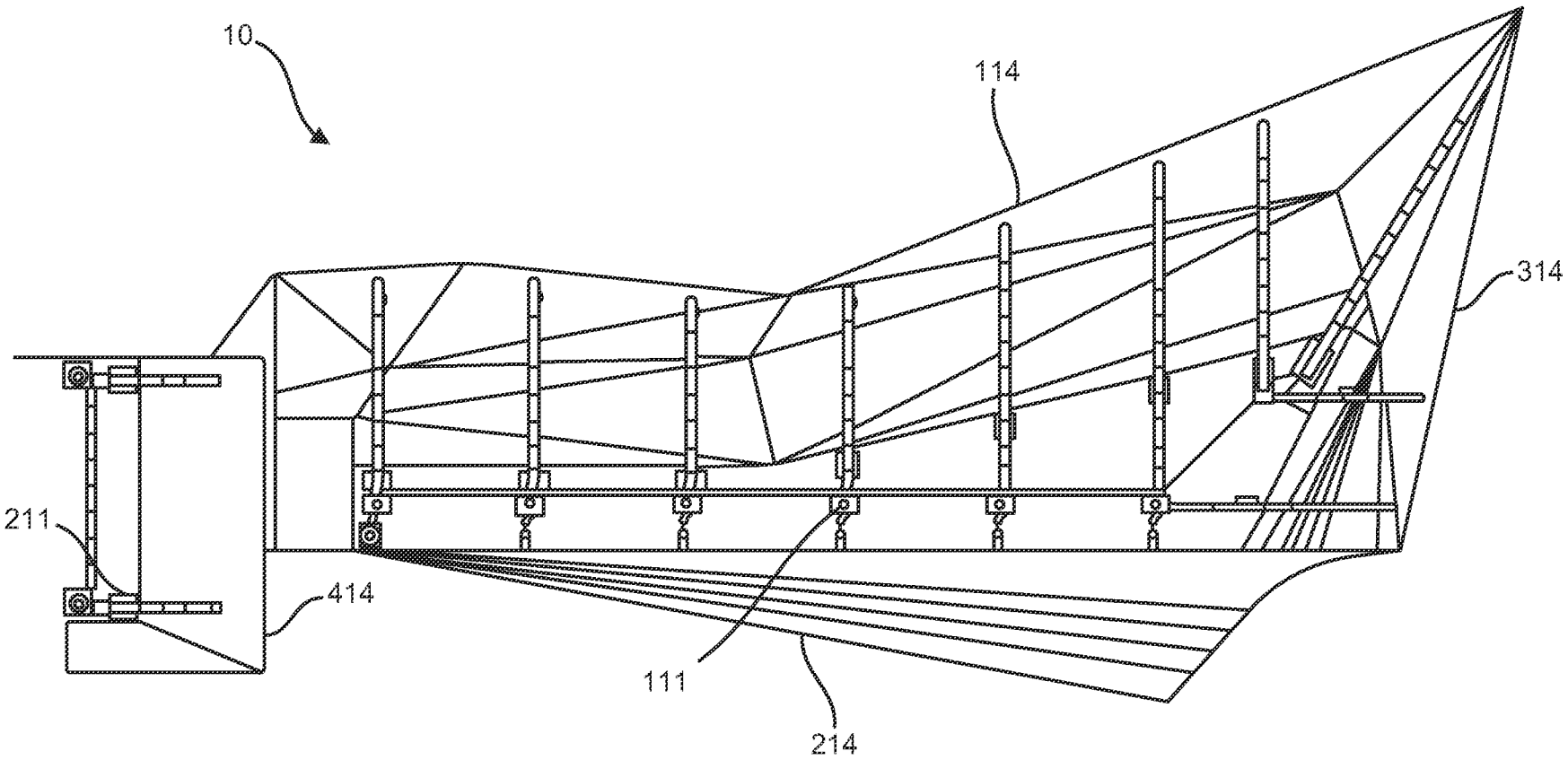
FIG. 4 is a top plan view of the climbing wall shown in FIG. 3.
Figure 5:
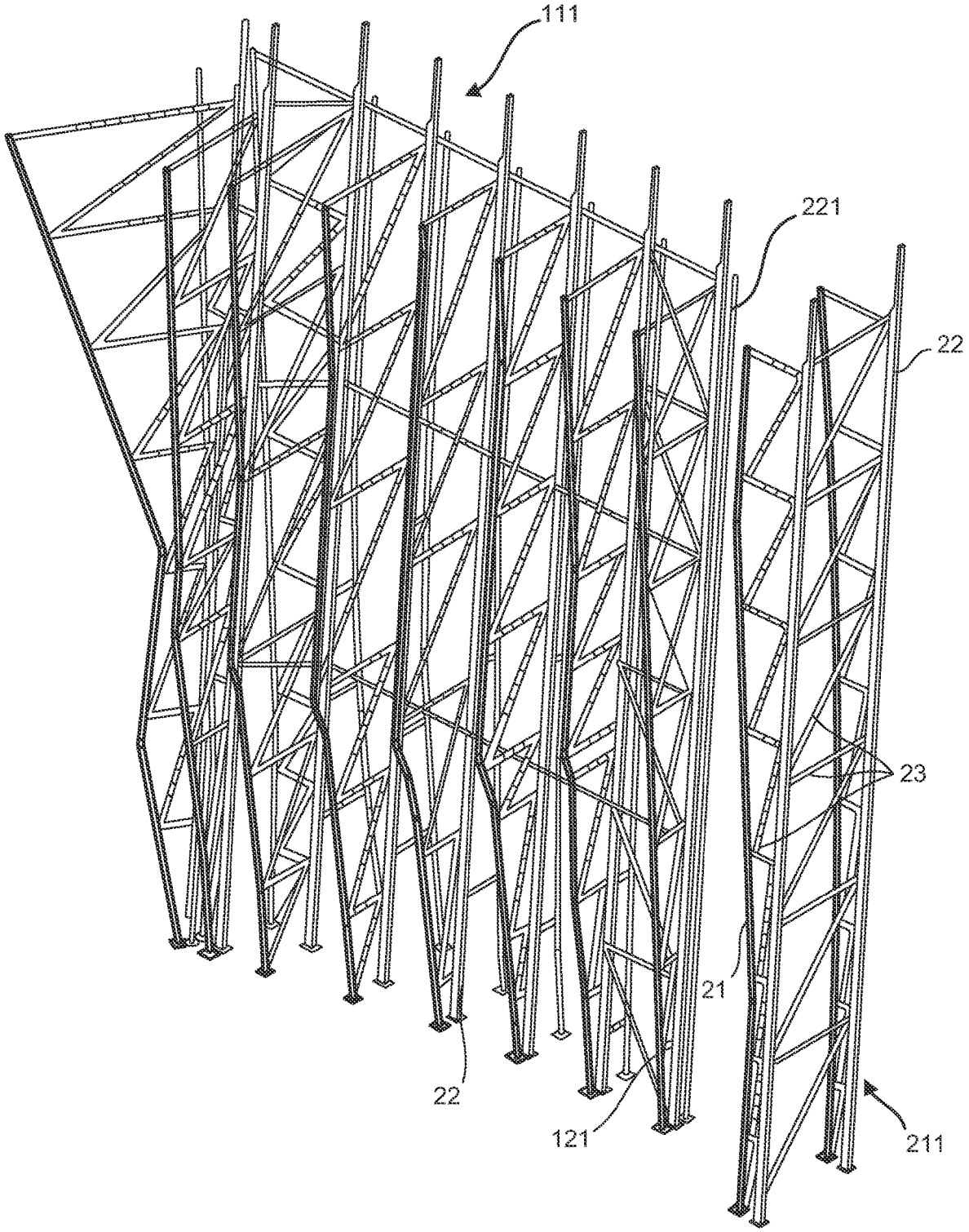
FIG. 5 is a front perspective view of the framework, or truss assembly, of the climbing wall shown in FIGS. 3 and 4.

In some embodiments, the climbing wall 10 may have climbing surfaces 14 on more than one side. For example, in some embodiments, the climbing wall 10 may have climbing surfaces 14 on at least two opposing sides. In some embodiments, the climbing wall 10 may have climbing surfaces 14 on all sides of a framework 11. An example of a climbing wall 10 having multiple climbing surfaces 14 is shown in FIGS. 3 and 4. In the illustrated embodiment, a first framework 111 supports a first climbing surface 114 on a front side of the framework, a second climbing surface 214 on a rear side of the framework, and a third climbing surface 314 on an end of the framework. A second framework 211 supports an additional climbing surface 414, which is connected to the climbing surfaces formed by the first framework 111.

Where the climbing wall 10 has climbing surfaces on at least two opposing sides, each opposing side may utilize independent support posts or, as illustrated in FIG. 5, the same support posts 22 may be used to support each climbing surface. Where support posts 22 are used to support climbing surfaces on two opposing sides of a climbing wall 10, the support posts 22 may be placed between a first set of front posts 121 and a second set of front posts 221. Depending on the size of the ends of the climbing wall assembly, additional front posts 21 may be included on the end (as shown on the left of framework 111 in FIG. 5) or a combination of the exiting front post(s) may provide adequate support for end-positioned climbing surfaces (as shown on the right of framework 111 in FIG. 5).

Connectors for Mounting Surface Panels to Front Posts

In some embodiments, the one or more surface panels 12 may be affixed to the front posts 21 using embodiments of the connectors 30 disclosed herein. Embodiments of the connectors 30 comprise a pane 31, which is configured to be affixed to the rear of a surface panel 12 and a securing bracket 32, which is configured to be affixed to a front post 21. The pane 31 and the securing bracket 32 are coupled by a fastener 33, and preferably by an adjustable fastener such as a carriage bolt or the like.

In some embodiments, the pane may comprise a buffer 34, which is a material that can be affixed to the rear of a surface panel 12 while allowing a climbing grip 13 to be affixed to the front of the surface panel directly opposite. In a conventional climbing wall, when mounted to a framework the surface panels comprise a metal substructure. Because climbing grips cannot be affixed to the front of the surface panel 12 where the metal substructure exists, the metal substructure limits the placement of climbing grips. The inclusion of a buffer 34 on embodiments of the connector 30 serves to avoid this problem. The buffer 34 may comprise any of a variety of materials. In some preferred embodiments, the buffer 34 may be made of wood.

In some embodiments, the securing bracket 32 may be configured to be attached at substantially any location along the front post 21. For example, the securing bracket 32 may comprise a channel 35 having an adjustable width. This may be achieved, for example, by providing a fastener 36 that can either be tightened, thereby reducing the width of the channel 35, or loosed, thereby increasing the width of the channel. Where the fastener 36 is loosened (or removed), the channel 35 has a width that allows for it to be positioned at a desired location along the length of a front post 21. When the fastener 36 is tightened, the width of the channel 36 can be reduced so that it is maintained at a desired location on the front post 21 by a friction fit.

In order to provide an effective friction fit, the portion of the securing bracket 32 that defines the channel 35 is desirably shaped to correspond with the shape of the front post 21. In the illustrated embodiment, for example, the portion of the securing bracket 32 that defines the channel 35 is rounded, in order to correspond with a rounded front post 21. However, the portion of the securing bracket 32 that defines the channel 35 may have a variety of shapes to correspond to differing front posts 21, including for example a portion defining a squared channel for use on squared front posts 21.

That said, the use of rounded front posts 21 and a securing bracket 32 having a curved portion defining the channel 35 provides additional benefits. Namely, the securing bracket 32 may be configured to extend at substantially any position around a circumference of the front post 21. For instance, when the fastener 36 is loosened (or removed), the securing bracket 32 can be rotated around the front post 21, so as to extend from the post in a desired direction. One the securing bracket 32 is positioned at a desired angle, the fastener 36 may be tightened and the securing bracket 32 secured to the front post 21. Absent any obstructions, e.g. braces 23, embodiments of the securing bracket 32 can be rotated 360° around the front post 21. In use, however, securing brackets 32 will generally only need to rotate within a 180° range (about the front of the framework 11), more typically only within about a 150° range (about 75° in either direction from front-facing) or less.

The ability to have the mounting plates 31 (with or without buffers 34) extend from the front posts 21 at a variety of angles greatly simplifies the construction of climbing surfaces 14 having multiple climbing planes 15. It also allows for the construction of climbing surfaces 14 having new geometries. For instance, using embodiments of the securing brackets 32 disclosed herein, multi-faceted or rounded surface panels 12 may be securely mounted. Accordingly, embodiments of the climbing walls 10 disclosed herein may for the first time comprise one or more rounded climbing surfaces 14. The use of multi-faceted surface panels 12 also provides a new, and relatively simple, way to create additional climbing planes 15. For instance, the use of multi-faceted surface panels 12 allows one to create a plurality of climbing planes 15 without the need for any additional framework 11 components. Instead, one need only affix securing brackets 32 to extend from the front post(s) at a plurality of angles, each angle being selected to support a different facet of the multi-faceted surface panel 12.

In order to enhance the ability of the plates 31 positioned at different angles to provide a strong connection with a surface panel 13, some embodiments of the connectors 30 disclosed herein may comprise a plate that has some side-to-side adjustability. This may be achieved, for example, by attaching fastener 33 in a manner that allows for a small degree of side-to-side movement. For example, the head of the fastener 33, such as a carriage bolt head, may be received in an opening that is flared to allow for some side-to-side movement. In the illustrated embodiment, for example, the head of fastener 33 may be secured between an inner plate 37 and an outer plate, here the buffer 34, with the cavity in which it is held being flared to allow for some side-to-side adjustability.

In some embodiments, the plates 31 may also be positioned at different vertical orientations, although this is most efficiently achieved through the use of the integral, variable-angle front posts 21 described herein. Nevertheless, it is noted that in order to enhance the ability of the plates 31 positioned at different vertical orientations to provide a strong connection with a surface panel 13, some embodiments of the connectors 30 disclosed herein may comprise a plate that has some up-and-down adjustability. This may be achieved, for example, by attaching fastener 33 in a manner that allows for a small degree of up-and-down movement. As described above, for example, the head of the fastener 33, such as a carriage bolt head, may be received in an opening that is flared to allow for some up-and-down movement. In the illustrated embodiment, for example, the head of fastener 33 may be secured between an inner plate 37 and an outer plate, here the buffer 34, with the cavity in which it is held being flared to allow for some up-and-down adjustability.

Figure 20A:
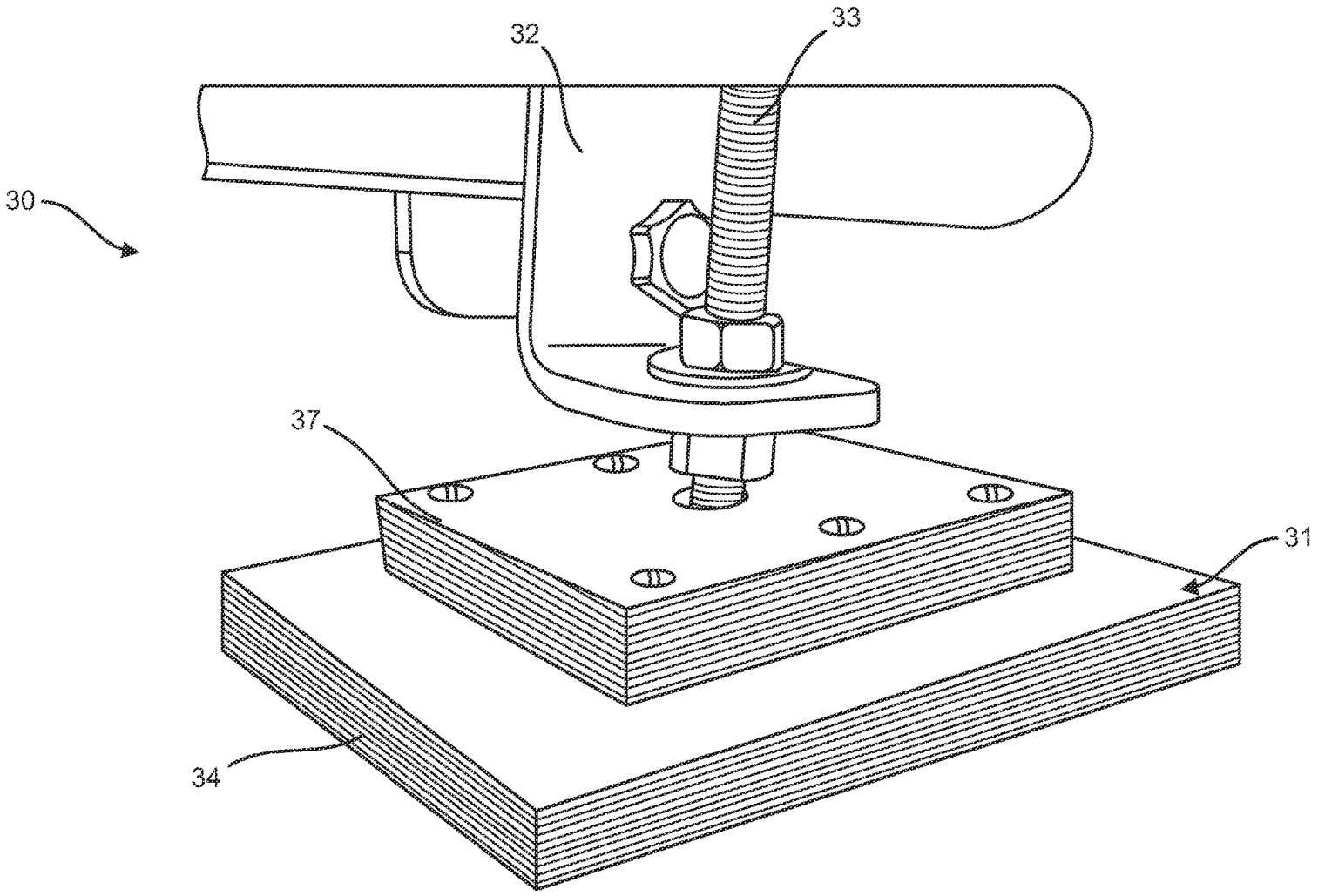
FIG. 20A is a perspective view of an embodiment of a connector in which the plate is rotated about the fastener in a first direction.
Figure 20B:
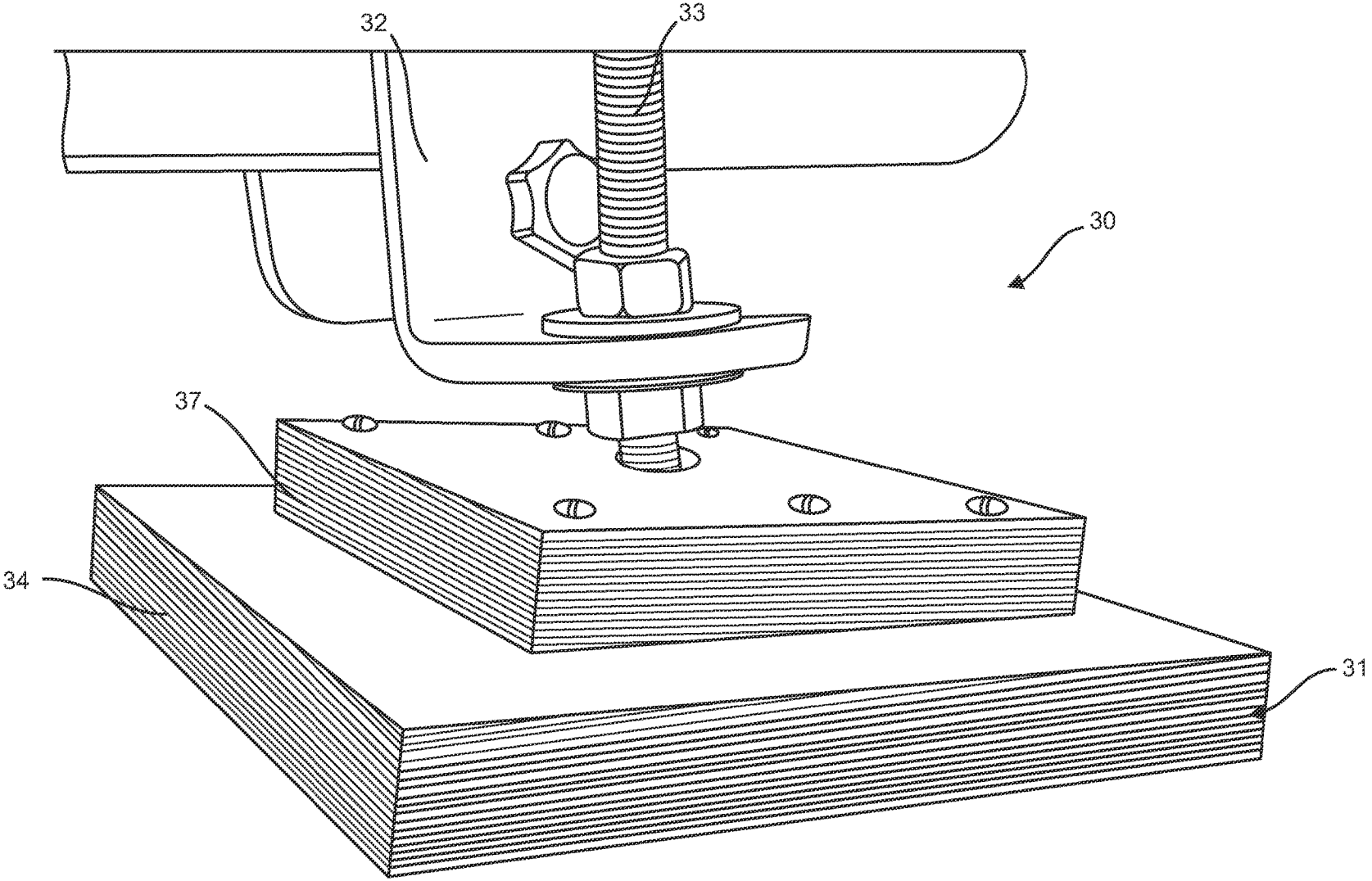
FIG. 20B is a perspective view of an embodiment of a connector in which the plate is rotated about the fastener in a second direction.
Figure 21:
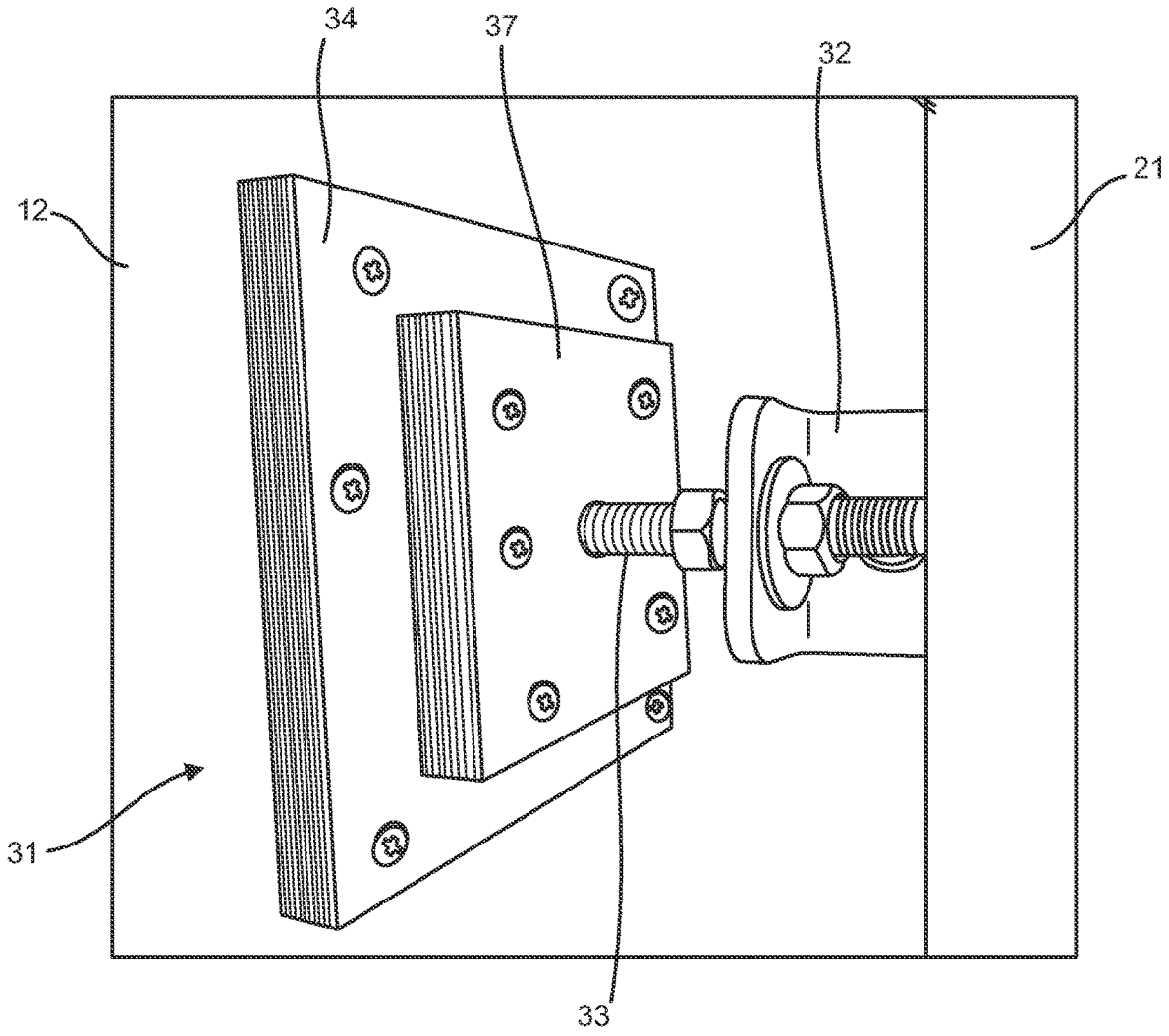
FIG. 21 is a perspective view of an embodiment of a connector in which the plate is rotated about the fastener so as to align the plate with a surface panel mounted thereon.

In some embodiments, for example, the plate 31 may be pivotable about the fastener 33. This allows for one to pivot the plate 31 about the fastener 33 in order to align the plate with a surface panel 12 during construction, which both (a) provides greater flexibility to produce unique climbing surfaces 14 and (b) provides a degree of tolerance that greatly simplifies the construction of a climbing wall 10. An example of such an embodiment is illustrated in FIGS. 20A, showing the plate 31 rotated in a first direction about the fastener 33, and FIG. 20B, showing the plate rotated in a second direction about the fastener.

In some embodiments, for example, the plate 31 may pivot at least ¼ inch in any direction about the fastener 33, alternatively the plate may pivot at least ½ inch in any direction about the fastener, alternatively the plate may pivot at least ¾ inch in any direction about the fastener, alternatively the plate may pivot at least 1 inch in any direction about the fastener, alternatively the plate may pivot at least 1.5 inches in any direction about the fastener. This pivoting allows one to adjust the angle formed between the plate 31 and the fastener 33 such that the plate may be placed at angles other than 90 degrees. For example, in some embodiments, the plate 31 may be pivotable to form angles with the fastener 33 within the range of 60 degrees to 90 degrees, alternatively within the range of 65 degrees to 90 degrees, alternatively within the range of 70 degrees to 90 degrees, alternatively within the range of 75 degrees to 90 degrees, alternatively within the range of 80 degrees to 90 degrees, alternatively within the range of 85 degrees to 90 degrees.

In some embodiments, the plate 31 may be configured to pivot about the fastener 33 by providing. For instance, the head of the fastener 33, such as a carriage bolt head, may be received in an opening that is flared to allow the head to pivot therein. In the illustrated embodiment, for example, the head of fastener 33 may be secured between an inner plate 37 and an outer plate, here the buffer 34, with the cavity in which it is held being flared to allow for pivoting. In some embodiments, the head of the fastener 33 may be rounded, thereby enabling enhanced pivoting of the fastener within the opening. Additionally, the aperture in the plate (e.g. an aperture in the inner plate 37) through which the fastener 33 passes may have a diameter that is larger than the cross-sectional diameter of the fastener. For example, the aperture in the inner plate 37 may be at least ½ inch larger than the cross-sectional diameter of the fastener 33, alternatively at least 1 inch larger than the diameter of the fastener, alternatively at least 1.5 inch later than the diameter of the fastener, alternatively at least 2 inches larger than the diameter of the fastener To further enhance the ease climbing wall 10 constructions and the versatility of the connectors 30, in some embodiments the distance between the plate 31 and the securing bracket 32 may be adjustable. For example, fastener 33 may be an adjustable fastener such as a carriage bolt. During construction, the fastener 33 may thus be configured to extend a desired distance from the securing bracket 32 before being firmly tightened to the securing bracket. The ability to adjust the distance between the plate 31 and the securing bracket 32 allows for a single connector 30 to be used to attach a variety of surface panels 12. The ability to adjust the distance between the late 31 and the securing bracket 32 is also of particular benefit where the connectors 30 are to extend at various angles around the front post, as the distances to the surface panel(s) mounted thereto are likely to vary.

Figure 6:
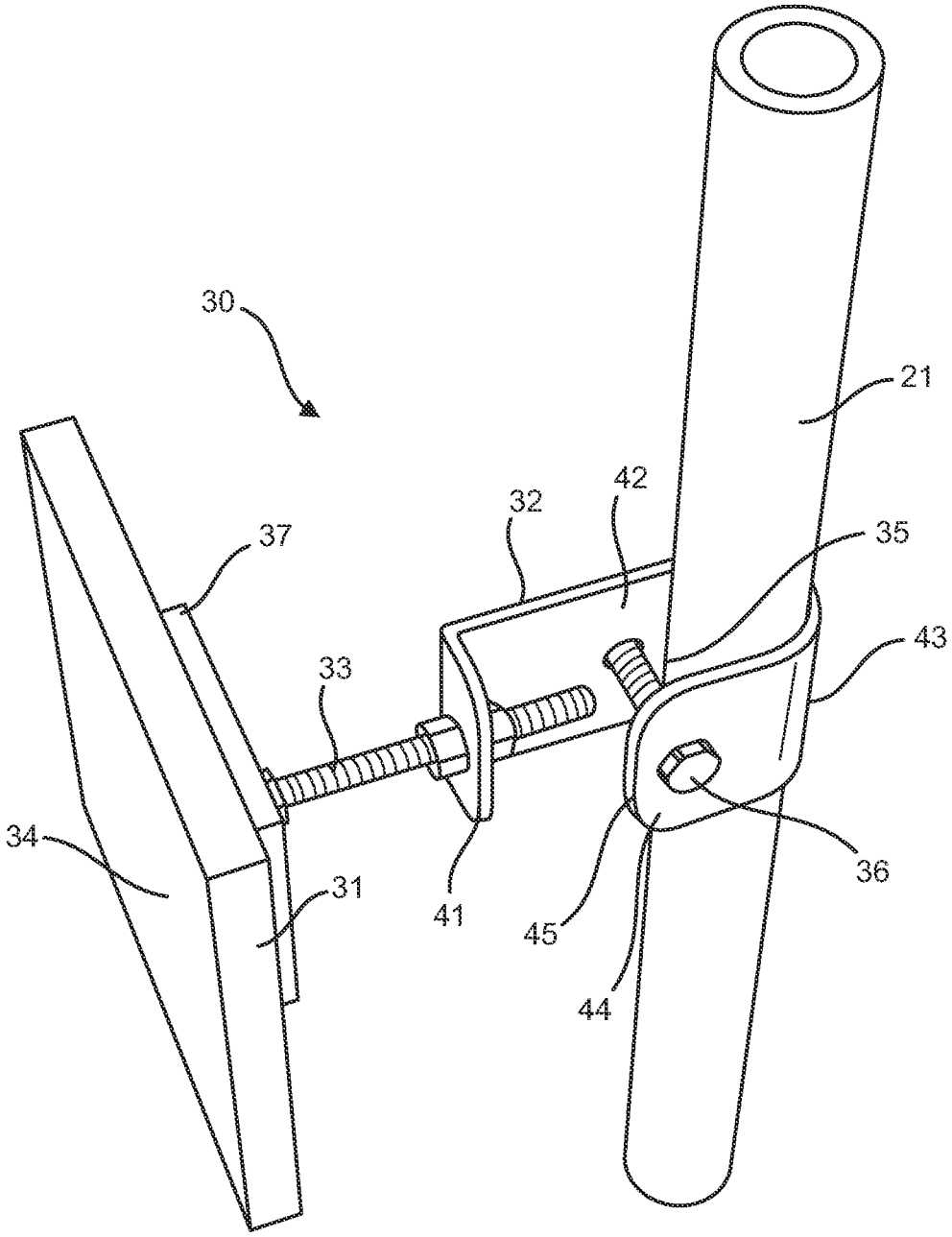
FIG. 6 is a front, right side perspective view of an embodiment of a mounting bracket comprising a buffer and a securing bracket.
Figure 7:
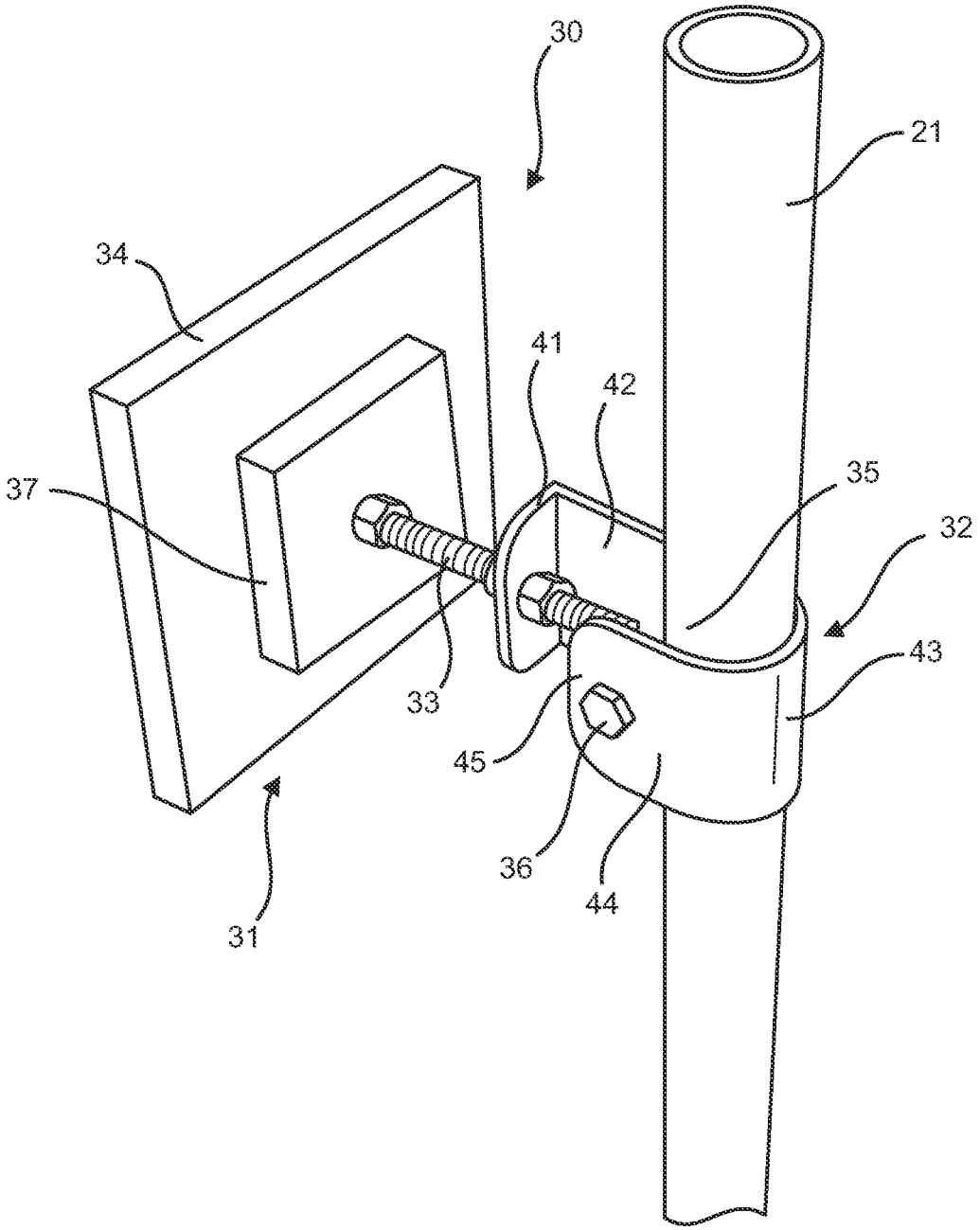
FIG. 7 is a rear, right side perspective view of an embodiment of a mounting bracket comprising a buffer and a securing bracket.

A particular embodiment of a securing bracket 32 is shown in FIGS. 6 and 7. As shown in the illustrated embodiment, the securing bracket 32 may comprise a front face 41, a first side portion 42, a rear portion 43, and a second side portion 44. The front face 41 comprises an aperture configured to receive fastener 33. The first side portion 42 spans between the front face 41 and the rear portion 43. The rear portion 43 spans between the first side portion 42 and the second side portion 44. The second side portion 44 spans between the rear portion 43 and a free end 45. The first side portion 42, second side portion 44, and rear portion 43 define the channel 35. As illustrated, the rear portion 43 may be curved in order to correspond to a rounded front post 21. As shown in the illustrated embodiment, the curved rear portion 43 may be configured to partially surround the front post 21. Moreover, in some embodiments, such as that illustrated, a single integral component, such as a single formed metal structure, may comprise the front face 41, the first and second side portions 42, 44, and the rear portion 43.

Each of the first side portion 42 and the second side portion 44 may comprise an aperture configured to receive fastener 36. Fastener 36 may be inserted through each of these apertures to connect the first side portion 42 and the second side portion 44. Fastener 36 can be used as described above in order to affix the securing bracket 32 to the front post 21 or to allow for movement of the securing bracket 32 along and/or around (or off) the front post 21. Specifically, when fastener 36 is tightened, the first side portion 42 and the second side portion 44 are brought together, narrowing the channel 35 and clasping the front post 21 within the channel. When fastener 36 is loosened or removed, the first side portion 42 and the second side portion 44 may easily be moved away from other to widen the channel 35 and allow for movement of the securing bracket 32 about the front post 21. In the illustrated embodiment, fastener 36 comprises a carriage bolt.

As illustrated, the securing bracket 32 may be configured such that the free end 45 of the second side portion 44 and the front face 41 define an opening that is sized to allow for insertion of a front post 21 into channel 35 (when fastener 36 is removed). For instance, the front face 41 may extend less than the full distance between the first side portion 42 and the second side portion 44. The second side portion 44 may have a length that is less than the length of the first side portion 42. This configuration provides for the easy mounting of the securing brackets 32 on the front posts 21. Indeed, one need merely insert the front post 21 between the front face 41 and the free end 45 of the second side portion 44 and into the channel 35, insert fastener 36 through the apertures in the first and second side portions 42, 44, and then tighten the fastener to affix the securing bracket 32 to the front post.

Adjustment of the position of the securing bracket 32 along the length of the front post 21 is equally simple, as the fastener 36 can simply be loosened, the securing bracket moved to a desired position along the length of the front post, and the fastener 36 can be tightened to affix the securing bracket to the front post at the desired position. Similarly, adjustment of the position of the securing bracket 32 along the circumference of the front post 21 is equally simple, as the fastener 36 can simply be loosened, the securing bracket moved to a desired position along the circumference of the front post, and the fastener 36 can be tightened to affix the securing bracket to the front post at the desired position. When used in some locations, however, it may be desirable to weld the securing bracket 32 to the front post 21 once assembled in order to provide additional strength where it may be necessary to support an increased load. This may be desirable, for instance, at locations where a rope for lead climbing may be clipped.

Adjustable Braces

In some embodiments, one or more of the braces 23 used in the framework 11 may be an embodiment of the adjustable braces 50 disclosed herein.

The adjustable braces 50 disclosed herein have adjustable lengths, rendering a single adjustable brace 50 suitable as braces in a variety of locations within a framework. By providing a number of adjustable braces 50 that cover different ranges of lengths, a small set of adjustable braces may provide all of the braces needed in constructing a complex climbing wall 10. This greatly simplifies the construction of a complex climbing wall 10. The use of the adjustable braces 50 disclosed herein also allows for one to ensure that each brace is positioned in exactly the right location. Moreover, the use of adjustable braces 50 provides climbing walls 10 with greatly enhanced adjustability. Because each adjustable brace 50 does not need to meet an exact specification for a particular use, one could change the contours of a climbing surface 14 and make use of generally the same set of adjustable braces.

Figure 8:
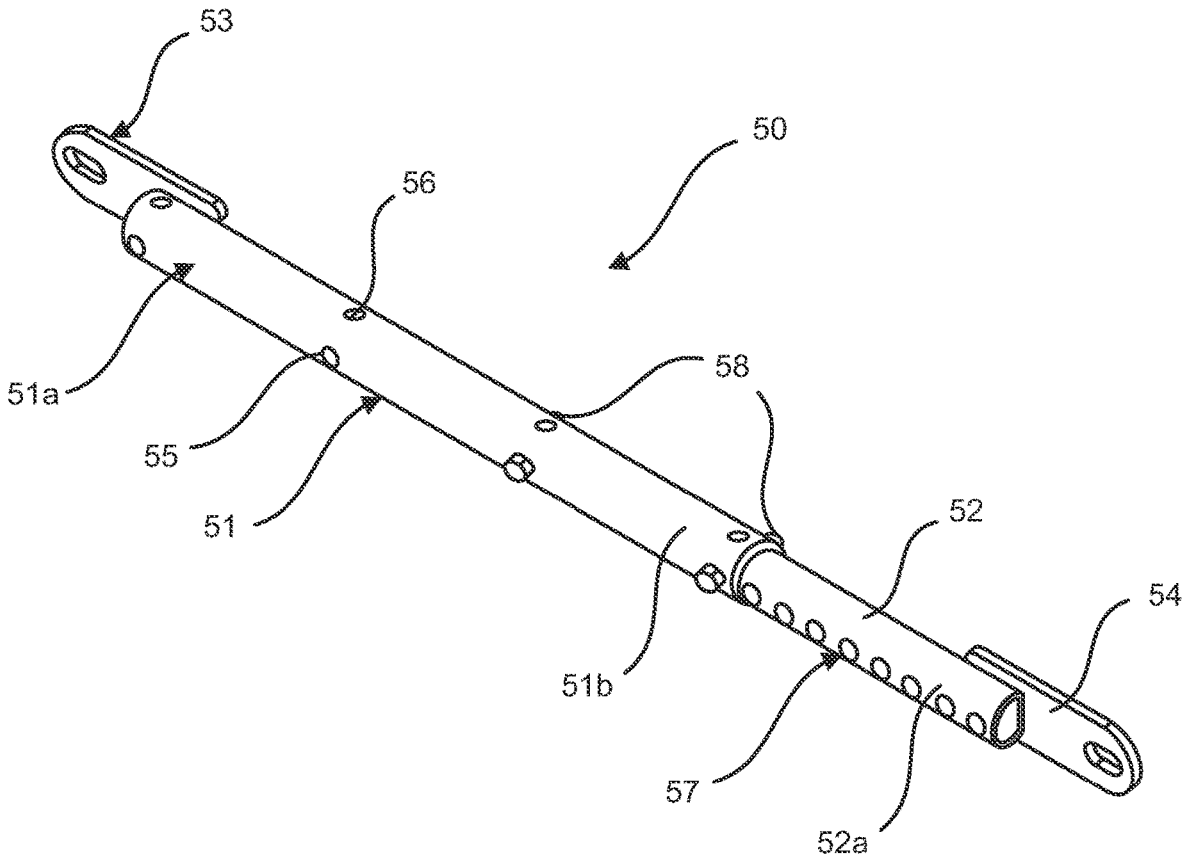
FIG. 8 is a front perspective view of an embodiment of an adjustable brace.

An embodiment of an adjustable brace 50 is shown in FIG. 8. As illustrated, embodiments of the adjustable braces 50 disclosed herein comprise an outer element 51 and an inner element 52. The outer element 51 comprises a hollow tube. The inner element 52 may also comprise a hollow tube. In the illustrated embodiment, each of the outer element 51 and the inner element 52 comprise round tubes. The inner element 52 has a smaller diameter than the outer element and is therefore slidably received within the outer element 51. In some embodiments, each of the inner and outer elements are made of stainless steel or galvanized steel.

The outer element 51 has a first end 51*a* that comprises a first mounting bracket 53. The outer element 51 has a second end 51*b* that is configured to receive the inner element 52. The inner element 52 has a first end 52*a* that comprises a second mounting bracket 54. The inner element 52 has a second end 52*b* that is configured to be received by the second end 51*b* of the outer element 51.

A portion of the inner element 52 is positioned within the outer element 51, such that a portion of the inner element extends from the second end 51*b* of the outer element 51. The inner element 52 may be slid within the outer element 51, such that the portion of the inner element that extends from the second end 51*b* of the outer element may have a variety of different lengths. In order to lock the inner element 52 at a desired position within the outer element 51, i.e. at a position where the inner element extends a desired length from the second end 51*b* of the outer element 51, each of the outer element and the inner element comprise a plurality of opposing apertures (apertures on opposing surfaces of the element) along its length into which a plurality of fasteners can be inserted.

The outer element 51 comprises a first plurality of opposing apertures 55 along its length. In some embodiments, such as that illustrated in FIG. 8, the outer element 51 may also comprise a second plurality of opposing apertures 56. The inner element 52 comprises a plurality of opposing apertures 57 along its length. Each of the opposing apertures 55, 56, 57 is configured to receive a fastener 58. Accordingly, to lock the inner element 52 and the outer element 51 together at a selected length, one need only align an aperture 57 of the inner element 52 with an aperture 55, 56 of the outer element 51 and then insert a fastener through the aligned apertures. It is desirable that a plurality of the inner element apertures 57 align with a plurality of the outer element apertures 55, 56 at the same time. That way multiple fasteners 58 can be placed through multiple sets of aligned apertures 55, 56, 57. In the adjustable brace illustrated in FIG. 8, for instance, two fasteners 58 are inserted through aligned apertures 55, 57.

The number of different lengths that the adjustable brace 50 may be locked into is defined by the distance between adjacent apertures 55, 56, 57. Accordingly, to maximize the versatility of the adjustable brace 50, it is desirable that adjacent apertures on the outer element 55, 56, adjacent apertures on the inner element 57, or both are located close together. For instance, each of the plurality of apertures 55, 56, 57 may be spaced apart from one another by between about 0.5 inches and about 1.5 inches. In the embodiment illustrated in FIG. 8, for example, the apertures 57 on the inner element 52 are spaced apart from one another by about 1 inch.

As long as the apertures on one of the outer element 51 or the inner element 52 are close to one another (as described above), the apertures on the other element can be spaced further apart without limiting the versatility of the adjustable brace 50. In some embodiments, for example, each of the plurality of apertures on either the outer element 55, 56 or the inner element 57 may be spaced apart from each other by between about 2 inches and about 10 inches, alternatively between about 4 inches and about 8 inches. For instance, in the embodiment illustrated in FIG. 8, the apertures on the outer element 55, 56 are spaced apart from one another by about 6 inches.

In some embodiments, at least one of the outer element 51 and the inner element 52 may comprise a second set of opposing apertures that are offset from the first set of apertures by about 90°. For instance, in the embodiment illustrated in FIG. 8, the outer element 51 comprises a second plurality of apertures 56. The second plurality of apertures 56 is offset from the first plurality of apertures 55 by about 90°. Moreover, the inner unit 52 is rotatable, such that the plurality of apertures 57 on the inner unit can be caused to align with either the first plurality of apertures 55 on the outer unit 51 or the second plurality of apertures 56 on the outer unit. In this way, the inner unit 52 may be locked into a desired length in one of two orientations, the two orientations being offset by about 90°.

The ability to rotate and lock the inner unit 52 into place in two orientations provides the additional functionality that the mounting bracket 54 can be rotated into two different planes. Accordingly, the adjustable brace 50 can be configured so that the mounting bracket 54 is oriented in the same plane as, i.e. parallel with, mounting bracket 53 or so that the mounting bracket 54 is oriented in a different plane from, and more particularly perpendicular to, mounting bracket 53. This provides the adjustable brace 50 with an increased versatility, as it can be attached to front posts 21 and/or support posts 22 at different angles.

In other embodiments, the inner element 52, rather than the outer element 51, may comprise the second set of apertures 56. Alternatively, both the outer element 51 and the inner element 52 may comprise a second set of apertures 56.

Figure 9:
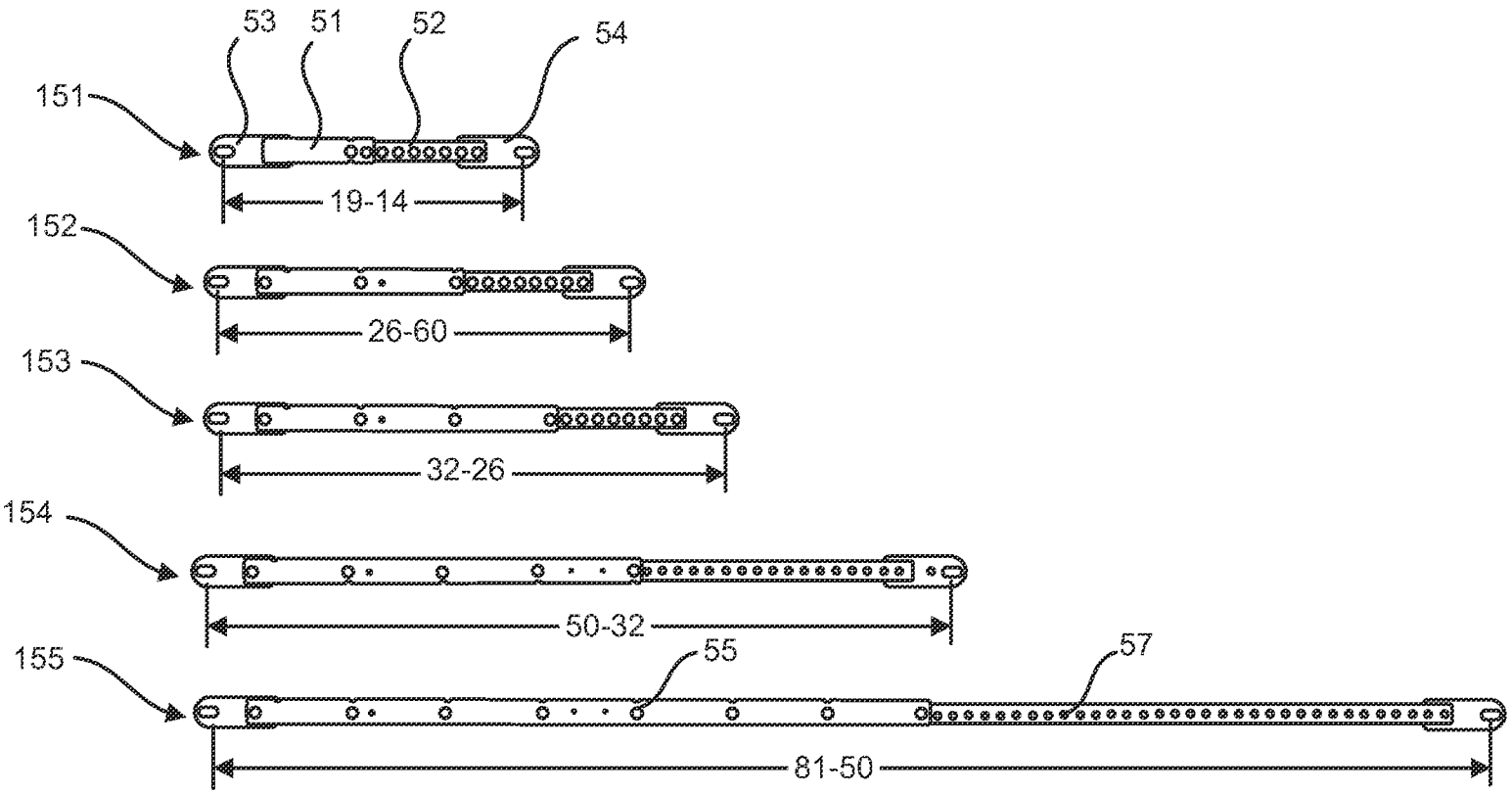
FIG. 9 is a front elevation view of embodiments of adjustable braces that are capable of having varying lengths.

Each adjustable brace 50 will have a minimum length, which is at least the length of the outer element 51 and the first and second mounting plates 53, 54. Accordingly, it may be desirable to provide a set of adjustable braces 50, with each adjustable brace in the set having a different range of potential lengths. An example of such a set is shown in FIG. 9. The set shown in FIG. 9 comprises an adjustable brace 151 configured to have lengths within the range of 14 inches to 19 inches, an adjustable brace 152 configured to have lengths within the range of 26 inches to 60 inches, an adjustable brace 153 configured to have lengths within the range of 26 inches to 32 inches, an adjustable brace 154 configured to have lengths within the range of 32 inches to 50 inches, and an adjustable brace 155 configured to have lengths within the range of 50 inches to 81 inches. The exact range of lengths for each adjustable brace 50 within a set may be selected based on typical climbing wall 10 dimensions.

Figure 12:
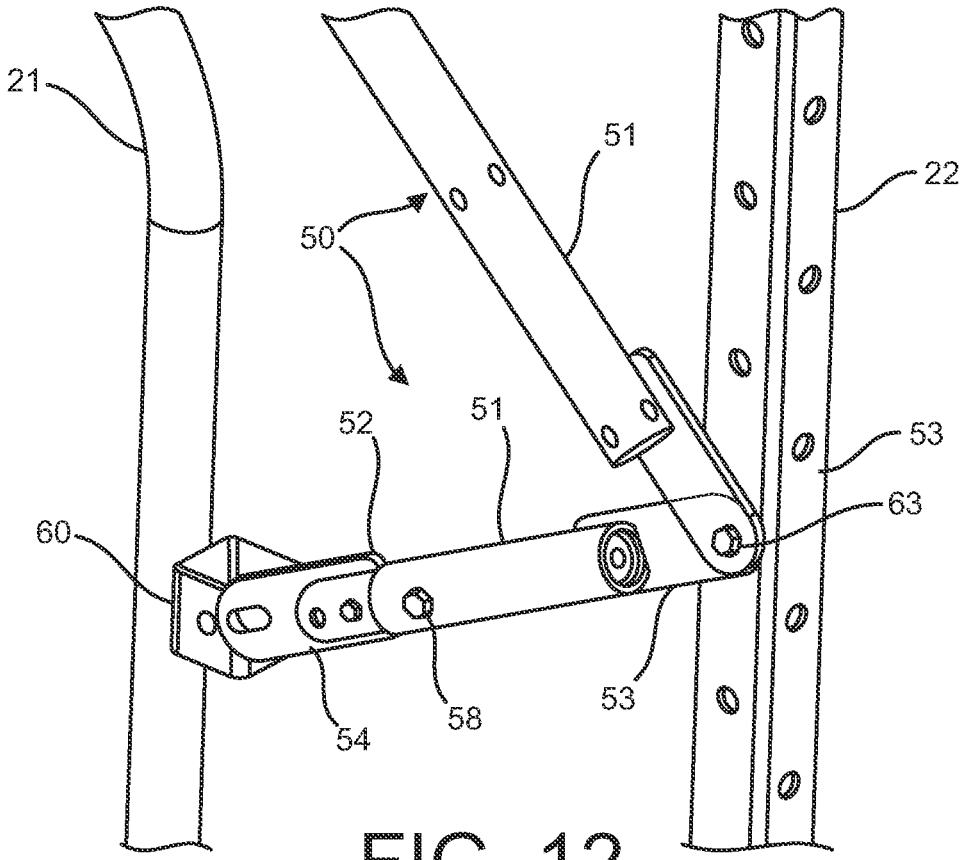
FIG. 12 is a perspective view of a portion of a climbing wall framework, showing embodiments of adjustable braces mounted to both a rounded front post and a square support post.
Figure 13:
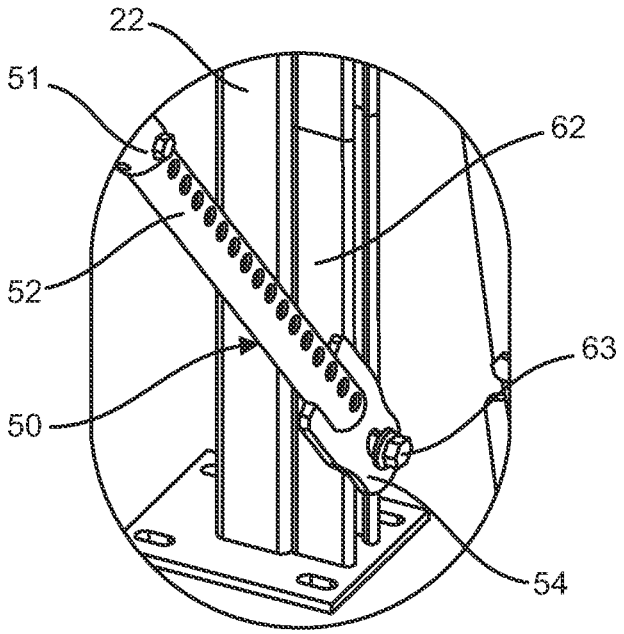
FIG. 13 is a perspective view of a portion of a climbing wall framework, showing embodiments of adjustable braces mounted to a support post weldment.

The adjustable braces 50 may be affixed to a front post 21, a support post 22, or both in a number of manners. A few manners for mounting embodiments of the adjustable braces 50 disclosed herein are shown in FIGS. 12 and 13. In some embodiments for instance, a front post 21 and/or a support post 22 may be a squared tube. The squared tube may comprise one or more apertures to which the mounting brackets 53, 54 of one or more adjustable braces 50 may be directly fastened using one or more fasteners 63. An example of such an arrangement is shown in FIG. 12 (on the right). Alternatively, a front post 21 and/or a support post 22 may be a rounded tube. In order to provide a secure attachment of an embodiment of the adjustable brace 50 to a round tube, a mounting block 60 or mounting flange 61 may be affixed, such as by welding, to the round tube at the desired location. The mounting block or flange 60, 61 may comprise one or more apertures to which the mounting brackets 53, 54 of one or more adjustable braces 50 may be fastened using one or more fasteners 63. An example of such an arrangement is shown in FIG. 12 (on the left).

Alternatively, in some embodiments, a front post 21 and/or a support post 22 may also comprise a weldment 62 configured so that the mounting brackets 53, 54 of one or more adjustable braces 50 may be fastened at any location along the length of the weldment 62. For example, the weldment 62 may comprise one or more channels to which the mounting brackets 53, 54 of one or more adjustable braces 50 may be fastened using one or more fasteners 63. The weldment 62 may be affixed, such as by welding, to a front post 21 and/or a support post 22 in order to provide a greater level of precision in mounting of one or more adjustable braces 50. An example of such an arrangement is shown in FIG. 13.

Figure 10:
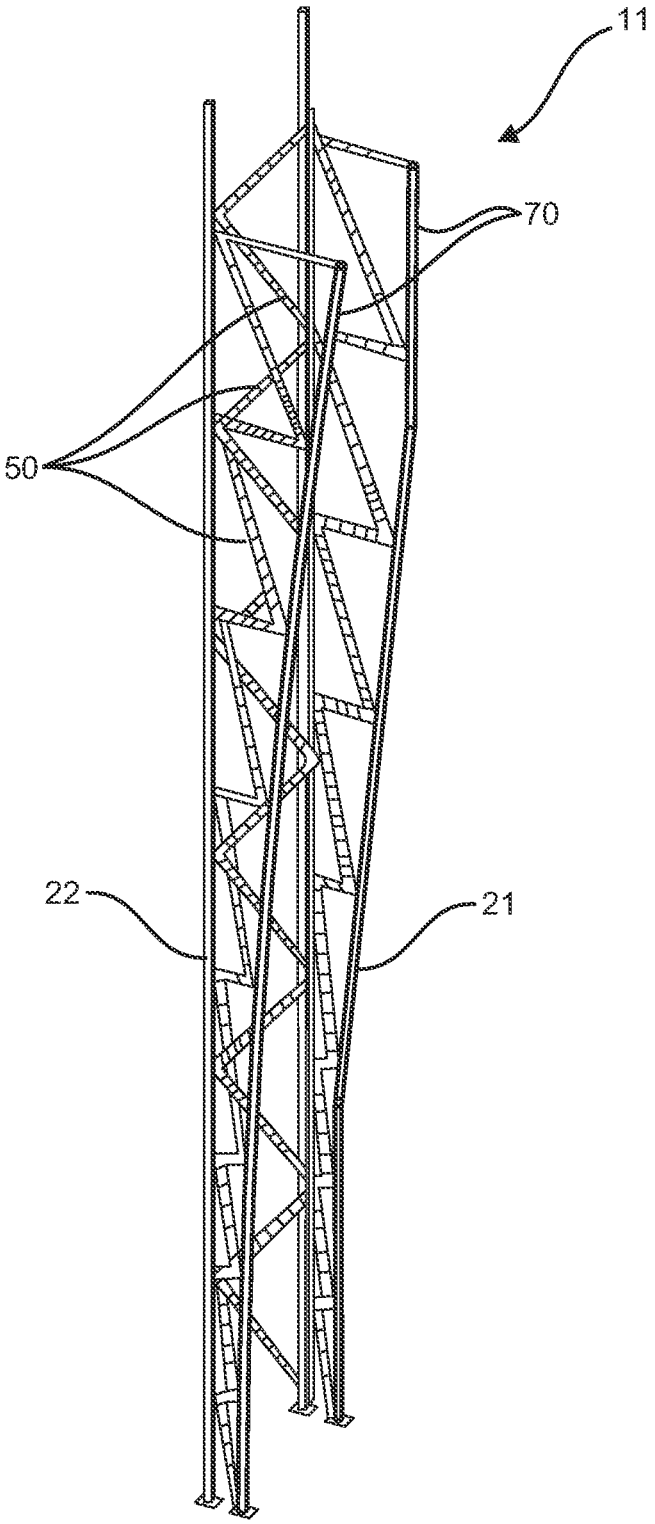
FIG. 10 is a front, left side perspective view of a portion of the framework from the embodiment of a climbing wall shown in FIGS. 3 to 5, showing the use of a plurality of adjustable braces.
Figure 11:
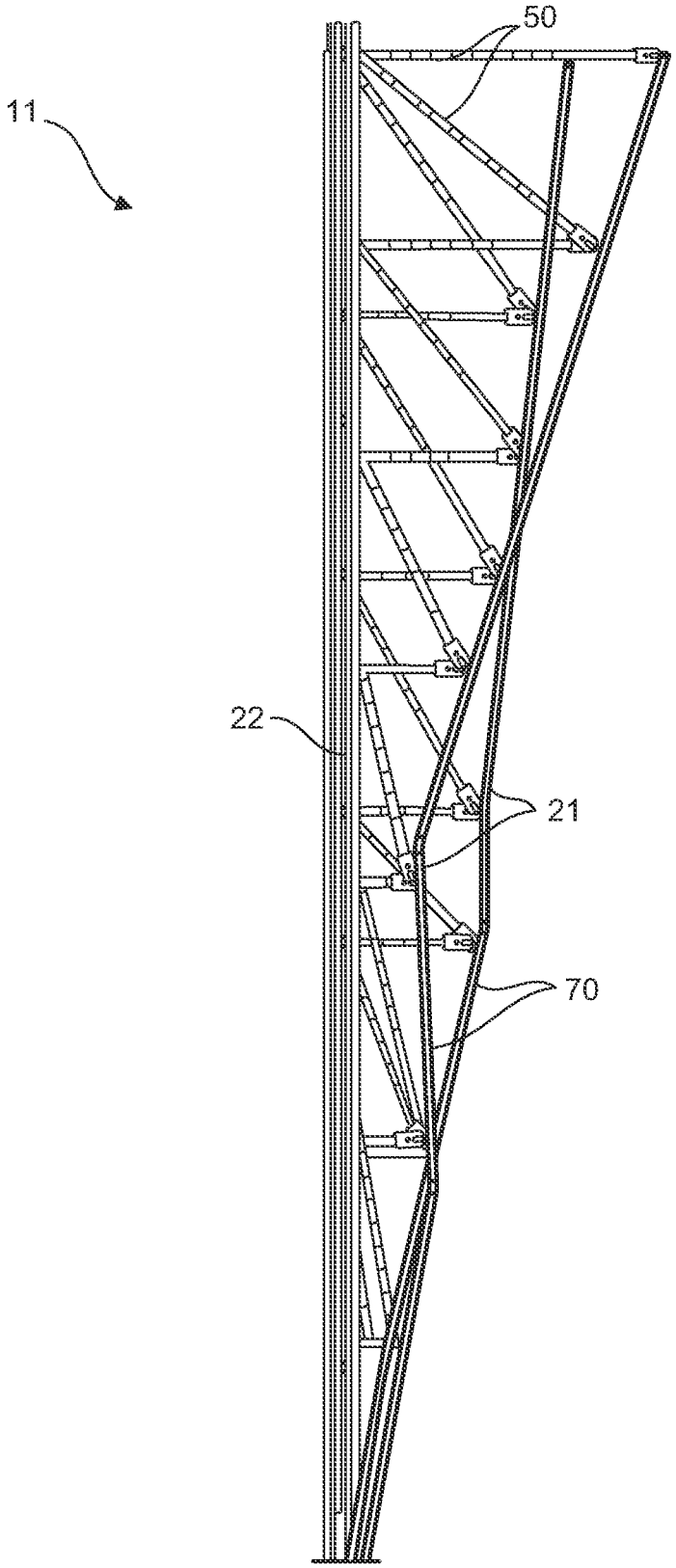
FIG. 11 is a left side elevation view of a portion of the framework from the embodiment of a climbing wall shown in FIGS. 3 to 5, showing the use of a plurality of adjustable braces.

Adjustable braces 50 such as those disclosed herein may be used extensively in the framework 11 for a complex climbing wall 10. For instance, one end of an adjustable brace 50 may be attached to a front post 21 and the other end of the adjustable brace may be attached to a support post 22. Other times, one end of an adjustable brace 50 may be attached to a support post 22 and the other end of the adjustable brace may be attached to an adjacent support post 22. Portions of frameworks 11 containing embodiments of the adjustable braces 50 disclosed herein are shown in FIGS. 10 and 11.

As seen in these Figures, a front post 21 may comprise a series of mounting blocks 60 or flanges 61 spaced apart along its length. A pair of adjustable braces 50 may be affixed to each mounting block 60 or flange 61. One adjustable brace 50 may span substantially horizontally, where the other end is affixed to a support post 22. The other adjustable brace 50 may be angled, with the other end affixed to the same support post, but at a higher location. As the angle of the front post 21 varies, the distances between the front post and the support post 22 that are spanned by the adjustable braces 50 changes. This can be most clearly seen in FIG. 11. Using conventional technology, one would have individual braces cut to each specific distance. The adjustable braces 50 disclosed herein provide a single component that can be used across a range of distances.

Integral, Variable-Angle Front Posts

In some embodiments, one or more of the front posts 21 used in the framework 11 may be an embodiment of the integral, variable-angle front posts 70 disclosed herein.

Integral, variable-angle front posts 70 comprise at least a first portion 71 extending at a first angle $\alpha 1$ relative to a vertical axis 200 and a second portion 72 extending at a second angle $\alpha 2$ relative to the vertical axis, wherein the second angle differs from the first angle. The integral variable-angle front posts 70 may comprise any number of portions extending at different angles relative to the vertical axis. For instance, some integral variable-angle front posts 70 comprise a third portion 73 extending at a third angle α3 relative to the vertical axis 200, some integral variable-angle front posts comprise a fourth portion 74 extending at a fourth angle α4 relative to the vertical axis, and so on.

Each portion 71, 72. 73, 74 extends at an angle α1, α2, α3, α4 that is different from the adjacent portions. In other words, the second portion 72 extends at an angle α2 that differs from the angles α1, α3 of the adjacent portions 71, 73. However, the fourth portion 74 may extend at an angle α4 that is either different from or identical to the angle α2 of the second portion 72.

In some embodiments, one or more portions of a variable-angle front post 70 are inclined inward, meaning that the portion moves toward the rear when traveling vertically upward. Accordingly, when one or more surface panels 12 are attached to this portion of the front post 70, the climbing surface 14 will be angled such that a user is positioned above the climbing surface. Each of the one or more portions that are inclined inward may be inclined at an angle between about 1 degree and about 90 degrees, alternatively between about 2 degrees and about 90 degrees, alternatively between about 2 degrees and about 85 degrees, alternatively between about 5 degrees and about 80 degrees, alternatively between about 10 degrees and about 75 degrees, alternatively between about 10 degrees and about 60 degrees, alternatively between about 10 degrees and about 50 degrees, alternatively between about 5 degrees and about 50 degrees, alternatively between about 2 degrees and about 25 degrees, alternatively between about 2 degrees and about 15 degrees.

In some embodiments, one or more portions of a variable-angle front post 70 are inclined outward, meaning that the portion moves toward the front when traveling vertically upward. Accordingly, when one or more surface panels 12 are attached to this portion of the front post 70, the climbing surface 14 will be angled such that a user is positioned below the climbing surface. Each of the one or more portions that are inclined outward may be inclined at an angle between about 1 degree and about 90 degrees, alternatively between about 2 degrees and about 90 degrees, alternatively between about 2 degrees and about 85 degrees, alternatively between about 5 degrees and about 80 degrees, alternatively between about 10 degrees and about 75 degrees, alternatively between about 10 degrees and about 60 degrees, alternatively between about 10 degrees and about 50 degrees, alternatively between about 5 degrees and about 50 degrees.

In some embodiments, one or more portions of a variable-angle front post 70 are substantially vertical, i.e. is angled about zero degrees relative to the vertical axis.

Figure 14:
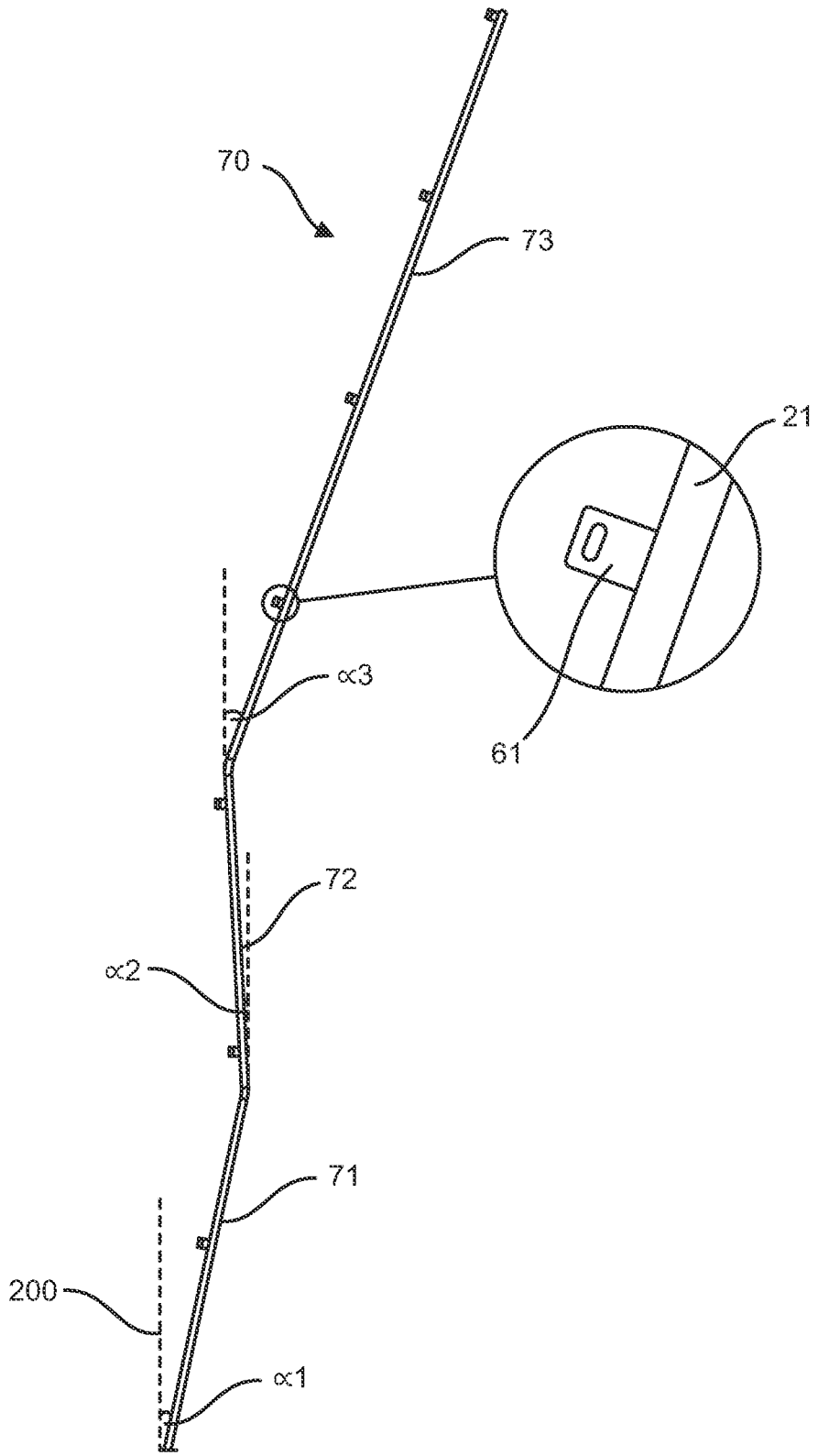
FIG. 14 is a left side elevation view of an embodiment of an integral, variable-angle front post.
Figure 15:
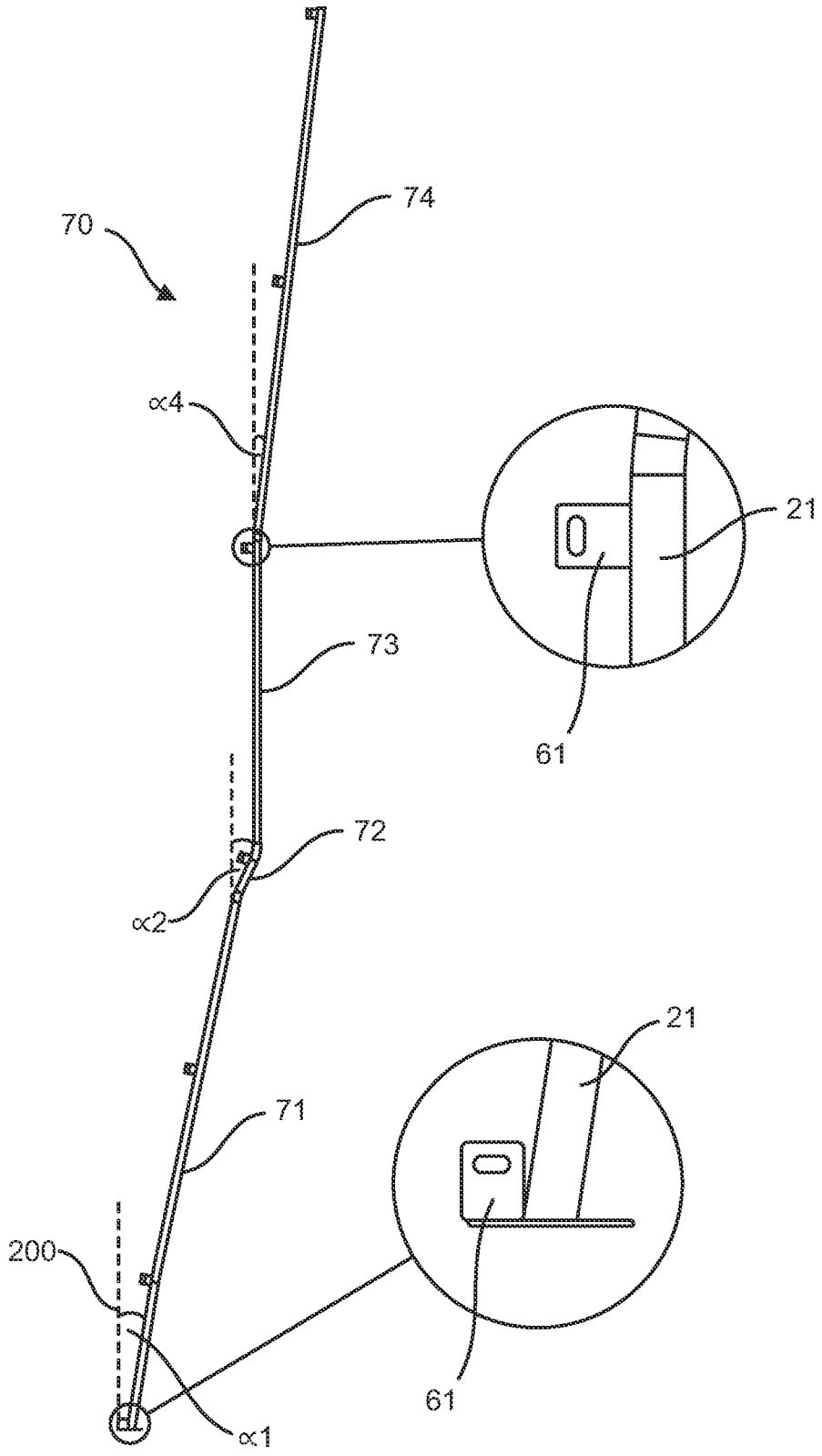
FIG. 15 is a left side elevation view of an embodiment of an integral, variable-angle front post.

Examples of integral, variable-angle front posts 70 are shown in FIGS. 14 and 15. The embodiment of the integral, variable-angle front post 70 shown in FIG. 14 comprises a first portion 71, a second portion 72, and a third portion 73. The first portion 71 is inclined outward at an angle α1 of about 20 degrees. The second portion 72 is inclined inward at an angle α2 of about 5 degrees. The third portion 73 is inclined outward at an angle α3 of about 30 degrees.

The embodiment of the integral, variable-angle front post 70 shown in FIG. 15 comprises a first portion 71, a second portion 72, a third portion 73, and a fourth portion 74. The first portion 71 is inclined outward at an angle α1 of about 15 degrees. The second portion 72 is inclined outward at an angle α2 of about 20 degrees. The third portion 73 is substantially vertical (i.e. the angle α3 is about zero degrees). The fourth portion 74 is inclined outward at an angle α4 of about 5 degrees.

One or more surface panels 12 may be mounted to each portion 71, 72, 73, 74 of an integral, variable-angle front post 70. For instance, one or more surface panels 12 may be mounted to each portion 71, 72, 73, 74 of an integral, variable-angle front post using one or more of the connectors 30 disclosed herein. The one or more surface panels 12 mounted to each portion may easily be caused to have the same angle of incline as that portion of the front post 70. Accordingly, the variable-angle front posts 70 disclosed herein allow for the easy creation of multiple climbing planes 15.

Embodiments of the variable-angle front posts 70 disclosed herein also provide for the creation of multiple climbing planes 15 without the need for welding numerous straight pipes together. The variable-angle front posts 70 are thus described as being integral, meaning that the length of the front post is formed by a single component and does not consist of multiple separate components that are welded together. Embodiments of the variable-angle front posts 70 may be formed by bending the tube during its manufacture.

In some embodiments, the integral, variable-angle front posts 70 may be round tubes. Additionally, in some embodiments, the integral, variable-angle front posts 70 may be stainless steel or galvanized steel. For example, where the front posts 21 are used in conjunction with the connectors 30 disclosed herein, one may construct a climbing wall 10 without needing to weld any components to the front posts 21 on-site. Therefore, the front posts 21 can be galvanized prior to being brought on-site for assembly.

By using embodiments of the integral, variable-angle front posts 70 disclosed herein in the framework 11, a complex climbing wall 10 having multiple climbing planes 15 may be more easily and efficiently constructed. Moreover, because the integral, variable-angle front posts 70 are configured to match the contour of each climbing plane 15, the connection of the surface panels 12 to the front posts 21 may have increased stability using relatively few parts.

Surface Panels

In some embodiments, one or more of the surface panels 12 used in the climbing wall 10 may be an embodiment of the improved surface panels 80 disclosed herein.

For example, one or more surface panels 80 may comprise a rounded edge. More particularly, at least two adjacent surface panels 80 may comprise rounded edges. Where the two adjacent surface panels 80 form different climbing planes 15, the rounded edges of the two adjacent surface panels contact one another to form a joint.

Figure 16:
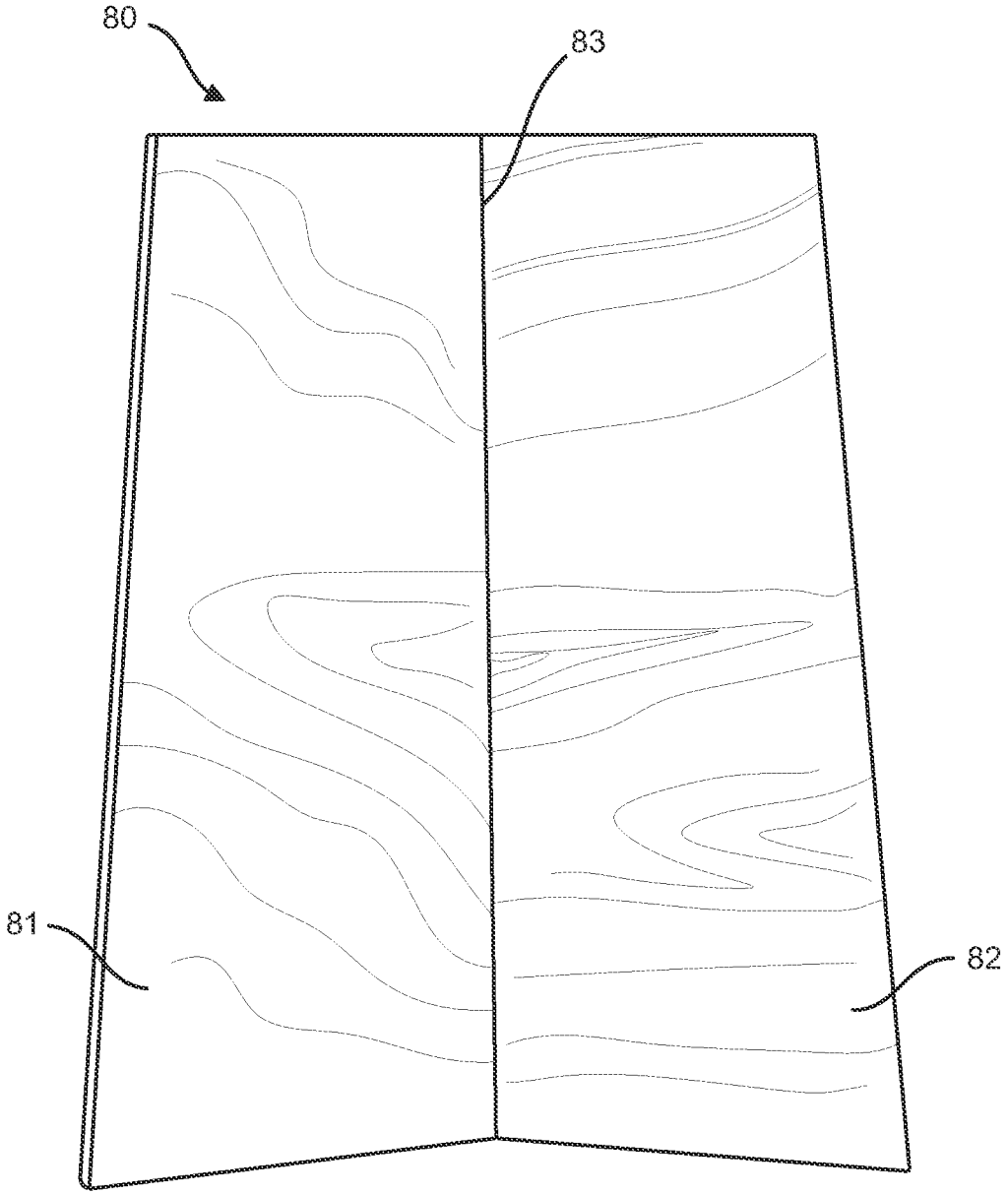
FIG. 16 is a front elevation view of an inner joint formed by embodiments of adjacent surface panels having rounded edges.
Figure 17:
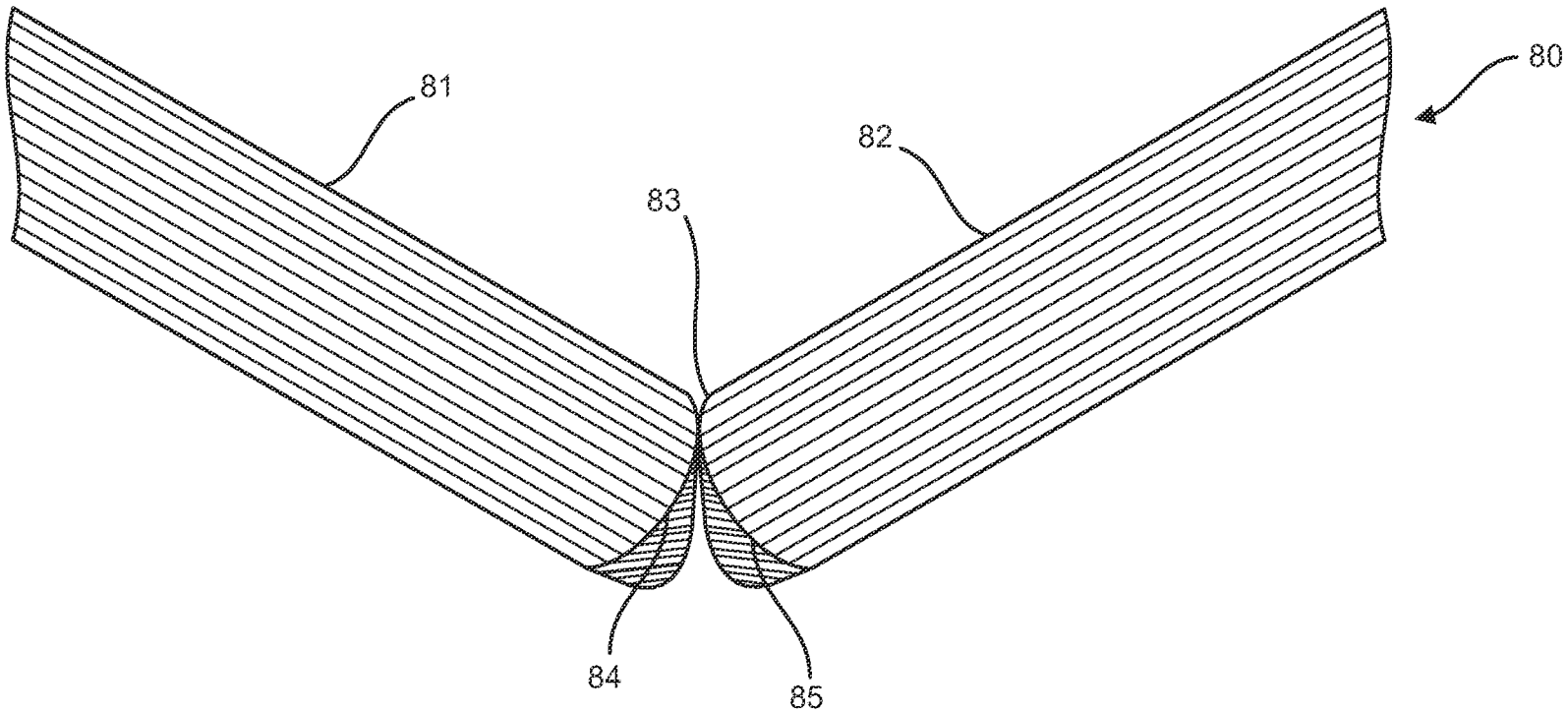
FIG. 17 is a bottom plan view of the joint shown in FIG. 16.

An example of such a configuration is shown in FIGS. 16-17. As illustrated a first surface panel 81 and a second surface panel 82, each of which is angled inward toward their intersection, meet to form a joint 83. The first surface panel 81 comprises a rounded edge 84. The second surface panel 82 also comprises a rounded edge 85. As seen in FIG. 17, the rounded edges 84, 85 of the first and second surface panels 81, 82 contact one another to form the joint 83.

Figure 18:
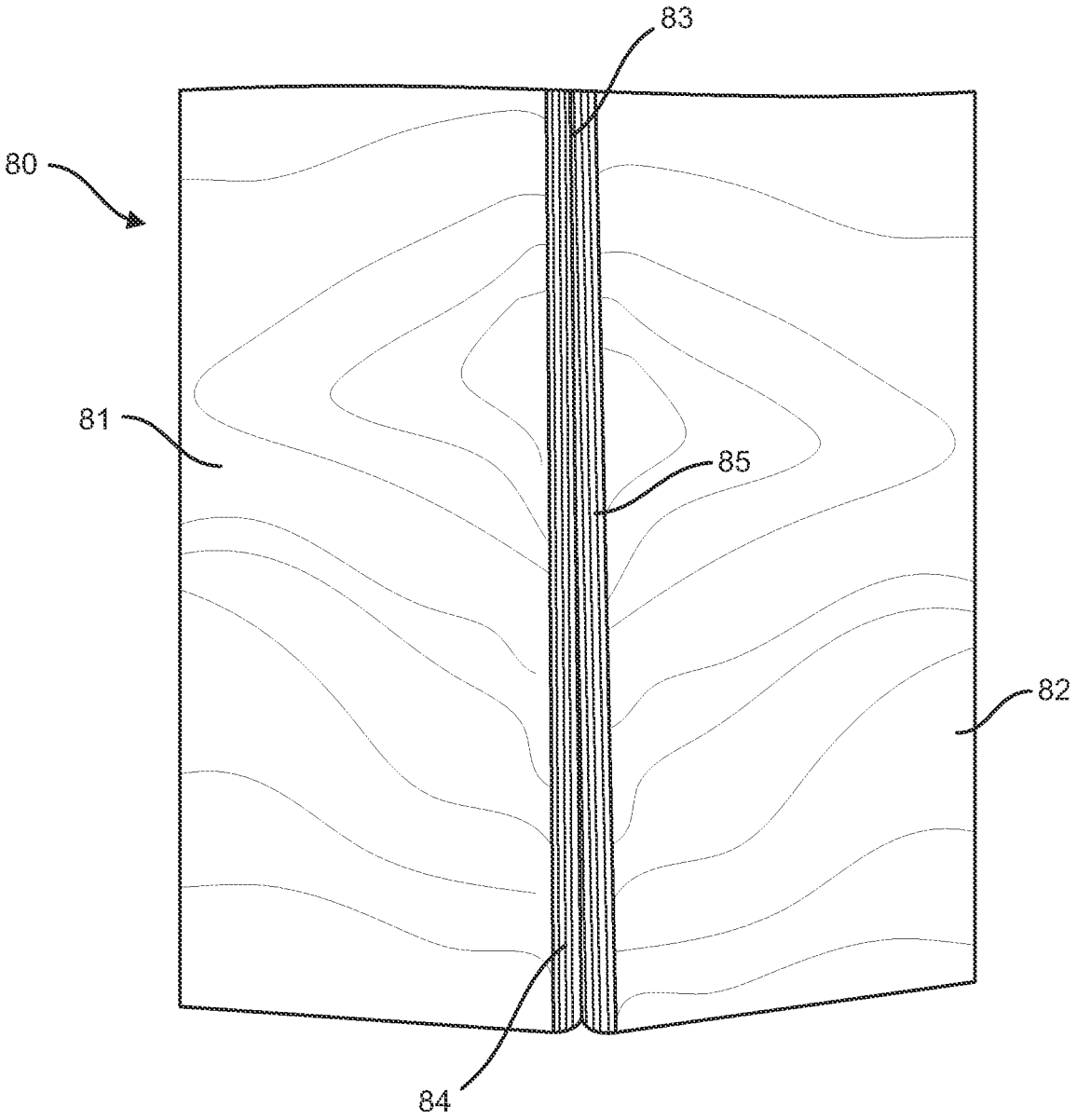
FIG. 18 is a front elevation view of an outer joint formed by embodiments of adjacent surface panels having rounded edges.
Figure 19:
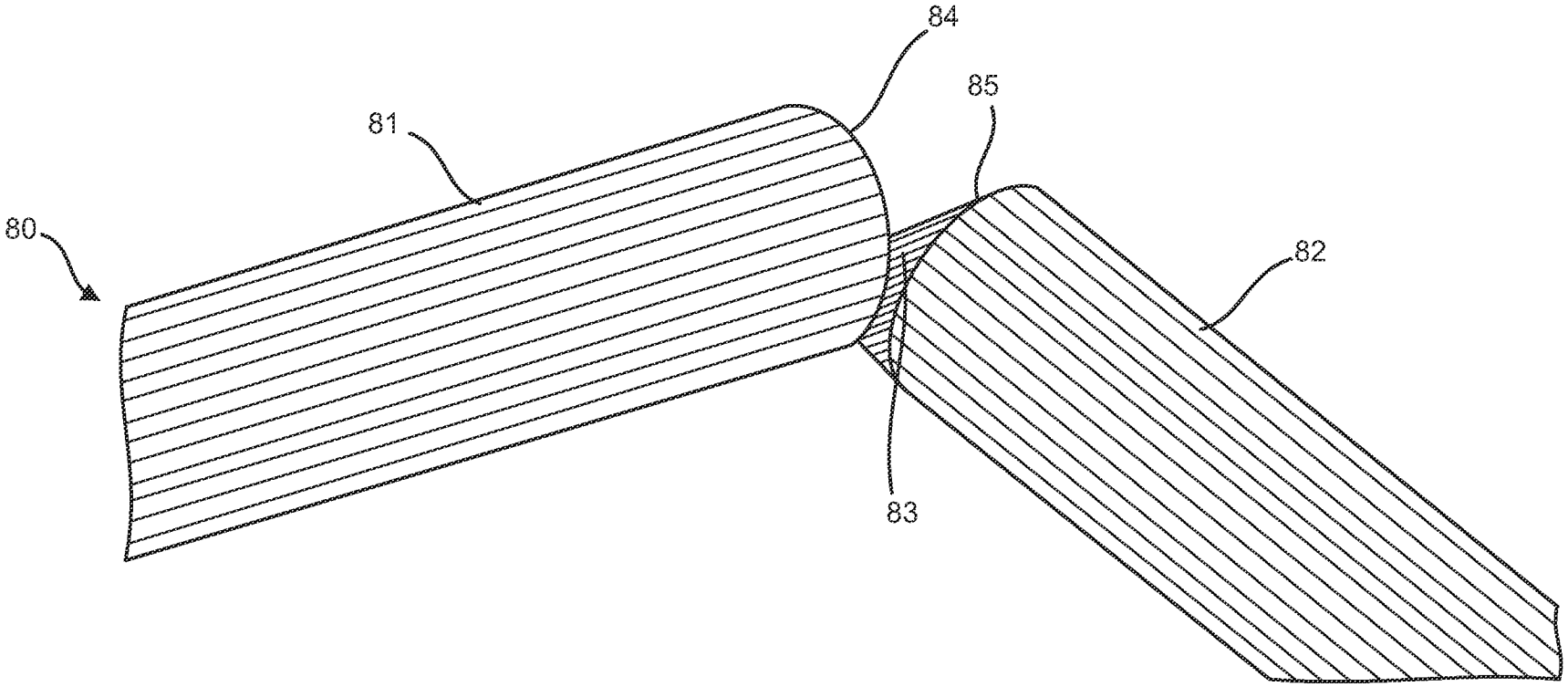
FIG. 19 is a bottom plan view of the joint shown in FIG. 18.

Another example of such a configuration is shown in FIGS. 18-19. As illustrated a first surface panel 81 and a second surface panel 82, each of which is angled outward toward their intersection, meet to form a joint 83. The first surface panel 81 comprises a rounded edge 84. The second surface panel 82 also comprises a rounded edge 85. As seen in FIG. 19, the rounded edges 84, 85 of the first and second surface panels 81, 82 contact one another to form the joint 83.

Although not illustrated, the rounded edges 84, 85 of the first and second surface panels 81, 82 may contact one another to form a joint 83 even where one of the surface panels is angled inward toward their intersection and the other is angled outward toward their intersection.

In conventional climbing walls, where two adjacent surface panels 12 that define different climbing planes 15 meet to form a joint, the surface panels 12 must be very precisely cut so that they fit together very exactly. The edges of the surface panels 12 must also be beveled (i.e. mitered) to achieve a tight joint. The formation of a tight joint is, in practice, very difficult to achieve given the many minor deviations that may come into play (e.g. inconsistencies in the floor surface, a slightly offset support structure, etc.). Moreover, if the relative angle of two adjacent surface panels 12 needs to be altered, one typically must obtain new surface panels which are precisely cut for the new angle. This means that adjustment of climbing planes 15 becomes very difficult and costly.

Further, where one or both of the conventional surface panels 12 are angled outward toward the intersection, a gap is formed. Gaps may also be formed where both surface panels 12 are angled inward toward the intersection, but where they do not perfectly align. These gaps are filled during construction of the climbing wall 10, typically with putty or some sort of other material. Gaps filled in this manner can be aesthetically displeasing and/or can produce a climbing surface 14 having an inconsistent texture.

Embodiments of the surface panels 80 disclosed herein avoid each of these problems.

First, because the edges 84, 85 of the adjacent surface panels 81, 82 are rounded, they do not need to be cut to a very precise angle or beveled. Rather, the adjacent surface panels 81, 82 can be brought together to form an array of different angles and still have the edges 84, 85 contact one another to form a joint 83. Accordingly, alterations or adjustments to the climbing surface may be performed without the need to obtain new surface panels 80. Rather, one may simply rotate the adjacent surface panels 81, 82 about the rounded edges 84, 85 to obtain a desired angle. For instance, once a first surface panel 81 is positioned, one may simply rotate the rounded edge 85 of the second surface panel 82 about the rounded edge 84 of the first surface panel until a desired angle is achieved. This may provide benefits both during construction of a climbing wall 10, e.g. by greatly simplifying the construction process, and after construction of a climbing wall, e.g. by allowing one to alter the climbing surface 14 to provide new and unique climbing opportunities without having to purchase entirely new surface panels.

Second, because the edges 84, 85 of the adjacent surface panels 81, 82 are rounded, gaps formed by the joint 83 do not need to be filled. In contrast to the rough, jagged surfaces exposed by a gap where conventional surface panels intersect, the exposed portions of the rounded edge surfaces 84, 85 exposed by the gap offer no safety hazard to users of the climbing wall 10. In fact, the rounded edge surfaces 84, 85 exposed within the joint 83 may be aesthetically and texturally pleasing. For instance, where the surface panels 80 are made of wood, the exposed rounded edge surfaces 84, 85 may expose the end grain of the wood panels, as seen for instance in FIG. 18.

In the illustrated embodiments, the entire surface of each edge 84, 85 is rounded, producing an edge having a radius of curvature that is half of the thickness of the surface panel 81, 82. However, other configurations are also contemplated, such as those in which only a portion of the edge surface is rounded, and in which the radius of curvature is either increased or decreased to suit specific needs.

In some embodiments, one or more of the surface panels 12 may comprise a textured surface that is substantially transparent. In some embodiments, each of the one or more surface panels 12 that make up the climbing surface 14 may comprise a textured surface that is substantially transparent.

The term "substantially transparent" as used herein means a surface that one can see light through and includes surfaces that might instead be considered translucent as opposed to transparent (though the specific boundary between the two may be vague). In some embodiments, one or more of the surface panels 12 may comprise a textured surface that is transparent. In some embodiments, one or more of the surface panels 12 may comprise a textured surface that is translucent. By textured, it is simply meant that the surface is not perfectly flat but rather has small local deviations throughout. Textured climbing surfaces 14 may be generally preferred for complex climbing walls 10 of the sort described herein, as they serve to prevent climbers from slipping on the climbing surface.

For instance, one or more of the surface panels 12 may comprise an aggregate dispersed in a substantially transparent matrix to form a substantially transparent, textured surface.

The substantially transparent matrix may be a substantially transparent polymeric material. In some embodiments, the substantially transparent polymeric material may be an epoxy or polyurethane. For example, the matrix may be a clear epoxy material. In some embodiments, the substantially transparent matrix may be tined or dyed to introduce color, such as to create certain visual effects.

The transparency of the matrix material may also vary. In some embodiments, the matrix material may have at least 80% transmittance of visible light ($T_v$), alternatively at least 85% transmittance of visible light ($T_v$), alternatively at least 90% transmittance of visible light ($T_v$). For instance, in some embodiments where a clear epoxy material is used as the matrix material, the matrix material may have about 91% transmittance of visible light ($T_v$).

The aggregate may comprise glass particles, a silica sand, a ceramic powder, a natural granular material such as that formed from organic materials (e.g. crushed walnut shells), or combinations thereof.

In some embodiments, the aggregate may comprise glass particles, such as glass beads, crushed glass, or a combination thereof. For example, the aggregate may comprise glass beads. In some embodiments, a substantial percentage, i.e. at least 60%, of the glass beads may be round. Alternatively, the aggregate may be crushed glass, such as crushed recycled glass. Both glass beads and crushed glass have a high degree of transparency. Crushed glass is coarser than substantially spherical glass beads, which provides the surface with a greater degree of friction. In some embodiments, the increased friction provided by the crushed glass may be desirable, for instance to increase the ability of a climber's shoe to stick to the climbing surface.

In some embodiments, for example, the climbing wall may comprise one or more volumes, which are obstacles that are attached to the climbing surface 14 and configured for a user to climb over. In these embodiments, the one or more volumes may comprise a crushed glass aggregate dispersed in a substantially transparent matrix to form a substantially transparent, textured surface while the climbing surface itself may comprise a glass bead aggregate dispersed in a substantially transparent matrix to form a substantially transparent, textured surface. While the surfaces themselves may have similar transparencies, the coarseness of the surfaces may differ. This may provide the one or more volumes with an increased friction or stickiness to assist a climber in overcoming the obstacle.

In some embodiments, the aggregate may be a light-transmitting silica sand. For instance, the light-transmitting silica sand can be quartzite sand, which transmits light clearly without adding significant coloration. Alternatively, the aggregate may be a colored material, which will produce a visual surface texture.

The aggregates may have a variety of particle sizes. One of the scales that is used to classify particle sizes is US Sieve Size. In some embodiments, the aggregates may have particle sizes with US Sieve Sizes within the range of 20 to 100, alternatively within the range of 25 to 90, alternatively within the range of 30 to 80, alternatively within the range of 40 to 70. For instance, in some embodiments, the aggregates may have particle sizes between about 100 microns and about 900 microns, alternatively between about 150 microns and about 850 microns, alternatively between about 200 microns and about 800 microns, alternatively between about 200 microns and about 600 microns. In some embodiments where crushed glass is used as the aggregate, the crushed glass may have grit sizes between G-14 and G-21.

The transparency of the aggregates may also vary. In some embodiments, the aggregates may have at least 75% transmittance of visible light ($T_v$), alternatively at least 80% transmittance of visible light ($T_v$), alternatively at least 85% transmittance of visible light ($T_v$), alternatively at least 90% transmittance of visible light ($T_v$). For instance, in some embodiments where glass particles are used as the aggregate, the aggregate may have about 91% transmittance of visible light ($T_v$).

The outer surface of the textured, substantially transparent surface panel 12, and in particular the outer surface of the aggregate dispersed in a substantially transparent matrix, may also comprise a top coat of clear polyurethane. A top coating of clear polyurethane seals the aggregate material within the matrix and prevents it from being dislodged during use of the climbing wall 10. The top coating of clear polyurethane may also increase the transparency of the matrix/aggregate material by filling the gaps in the aggregate crystals, thereby allowing light to travel straight through the aggregates as opposed to being dispersed by the crystallinity of the aggregate material.

The matrix comprising the dispersed aggregate may be coated on a base layer. In some embodiments, the base layer may itself be substantially transparent—allowing light from behind the surface panel 12 to shine through the panel. For example, the base layer may comprise a substantially transparent polycarbonate material. The base layer may comprise a substantially transparent material that is clear, or one having a color.

The climbing wall 10 may thus comprise one or more lights mounted behind the surface panels 12 that are visible through the one or more surface panels. For instance, in some embodiments, the climbing wall 10 may comprise one or more LED lights arranged behind the one or more surface panels 12. The LED lights may be color-changing in order to produce a variety of visual effects on the climbing surface 14. Moreover, an intermediate layer (e.g. a laminate), such as one comprising customized graphic elements, may be placed between the base layer and the matrix/aggregate coating. Accordingly, light from behind the surface panel 12 may cause the graphic elements of the laminate element to be illuminated on the climbing surface 14. Alternatively, the surface panel 12 may comprise a layer having one or more light-emitting elements as an intermediate layer between the base layer and the substantially transparent, textured outer surface layer. For instance, one or more LED lights or other color changing materials may be placed between the base layer and the surface layer. The light-emitting elements may themselves function to display graphic elements on the climbing surface 14.

Alternatively, the base layer may be opaque. For instance, in some embodiments, the base layer may be a wood panel. Accordingly, in some embodiments, the climbing surface 14 may have an aesthetically pleasing visual effect wherein the wood grain of the base layer is visible through the substantially transparent textured outer surface. The base layer may also be configured to comprise graphic elements that are visible on the climbing surface 14. For instance, the base layer itself may be configured to have certain graphic elements or an intermediate material (e.g. a laminate) having graphic elements may be placed between the base layer and the substantially transparent, textured coating.

In various embodiments described above, the climbing surface may have graphic elements visible underneath the substantially transparent, textured surface. In some embodiments, the graphic elements may comprise a business name, a business logo, an image associated with the installation location of the climbing wall, or a combination thereof. In some embodiments, the graphic elements may comprise a rockscape. In some embodiments, the graphic elements may change, as different lights or colors are activated. Thus, in some embodiments, the climbing surface 14 may take on any of a number of different visual appearances. A mechanism by which the visual appearance of the climbing surface 14 is altered may be mounted on the climbing surface itself, providing an interactive climbing experience.

In some embodiments, one or more of the surface panels 12 may comprise a flexible polymeric surface coating. In some embodiments, each of the one or more surface panels 12 that make up the climbing surface 14 may comprise a flexible polymeric surface coating. In some embodiments, the flexible polymeric surface coating may be elastomeric.

A flexible polymeric surface coating may provide the climbing wall with a number of advantages. The flexible polymer surface coating may be relatively soft (compared for example to the surface panel 12 itself), thereby providing a climbing surface 14 that reduces the potential for injuries to climbers. The coating may also prevent the climbing holds 13 from rotating about the climbing surface 14. For instance, in some embodiments the flexible polymeric coating may act as a gasket between a climbing hold 13 and the surface panel 12 to which the climbing hold is mounted, preventing any rotation or other movement of the climbing hold about the surface panel.

In contrast to padding of the sort that might be fastened or affixed to a climbing surface, the flexible polymeric surface coating is coated onto the surface panel so as to be integral with the surface panel. Accordingly, the flexible polymeric surface coating may not easily be dislodged from the climbing surface 14. For instance, the flexible polymeric surface coating may be applied to a surface panel by spray coating, e.g. by an industrial spraying process. In some embodiments, for example, the flexible polymeric surface coating may be a polyurethane spray coating or a polyurea spray coating. In some embodiments, a primer may be applied to the surface panel prior to the flexible polymeric surface coating. The flexible polymeric surface coating may be applied as a substantially uniform coating.

One important property of the flexible polymeric surface coating is the softness of the coating material, which may be measured by one or more Shore hardness values. In some instances, a body part of a climber may impact the climbing surface 14 with some force. It is therefore desirable that the climbing surface have some degree of softness, thereby reducing the effects of the impact on the climber's body. One way to measure this property is through Shore hardness testing. Shore hardness is a measure of the resistance of a material to indentation. Shore hardness is tested with an instrument called a durometer and is typically measured using two scales: the Shore D scale, which is used for testing most polymers, and the Shore A scale, which is used specifically for soft polymers. Each scale ranges from 0 to 100, with a higher value indicating a harder (i.e. less flexible) material and a lower value indicating a softer (i.e. more flexible) material.

In some embodiments, the flexible polymeric coating may have a Shore D hardness of 70 or less, alternatively 60 or less, alternatively 50 or less, alternatively 30 or less, alternatively 25 or less, alternatively 20 or less. Moreover, in some embodiments, the flexible polymeric coating may have a Shore A hardness of 90 or less, alternatively 80 or less, alternatively 70 or less, alternatively 60 or less, alternatively 50 or less.

Another important property of the flexible polymeric coating is durability, which may be measured by abrasion resistance. For instance, it is desirable that stresses placed on the climbing surface during climbing activities do not cause breaks in the coating or otherwise wear out the coating. One way to measure the resistance of a coating to this sort of wear is through abrasion resistance testing. One generally accepted method for measuring abrasion resistance is through the use of ASTM standard ASTM D 4060. Using that test method, a coating is applied at uniform thickness to a plane, rigid panel and then the surface is abraded by rotating the panel under weighted abrasive wheels. Abrasion resistance may be calculated as the loss in weight of a coating after a specified number of abrasion cycles.

In some embodiments, a 1 kg sample of the flexible polymeric surface coating may have a weight loss of less than 600 mg after 1000 cycles of abrasion testing in accordance with ASTM D 4060, alternatively less than 500 mg, alternatively less than 450 mg, alternatively less than 400 mg, alternatively less than 350 mg, alternatively less than 300 mg, alternatively less than 250 mg, alternatively less than 200 mg.

In some embodiments, the flexible polymeric surface coating may conceal scratches in the surface. For instance, it has been discovered that when the surface of the flexible polymeric surface coating is sliced with a knife or other bladed object, the surface does not show evidence of being sliced (when viewed with the naked eye). Accordingly, embodiments of the flexible polymeric surface coating may be able to withstand a scratch or slice without any visible damage to the surface. In some embodiments, the scratch or slice may have a thickness, i.e. width, up to 0.75 mm, alternatively up to 0.5 mm, alternatively up to 0.4 mm, alternatively up to 0.3 mm, without any visible damage to the surface of the flexible polymeric coating. Without being bound by theory, it is believed that the properties of the polymeric coating allows the material to fill-in the spaces created by such scratches and/or slices, such that it is nearly impossible to visibly discern where such a scratch or slice occurred. Therefore, embodiments of the flexible polymeric surface coating may be configured to conceal damage from sharp objects.

In some embodiments, the flexible polymeric surface coating may also be easy to clean. For instance, the flexible polymeric surface coating may be cleanable using a conventional sprayable cleaning agent or a conventional cleaning wipe containing a cleaning agent. Accordingly sweat, scuff marks, and the like may be easily removed from the climbing surface without the need for special treatment practices. The use of conventional cleaners as described above will not have any negative impact on the surface characteristics of the flexible polymeric surface coating.

In some embodiments the flexible polymeric surface coating may be water resistant. This may be an especially important property where the climbing wall is to be located outdoors. However, water resistivity may be important even on indoor climbing walls. The flexible polymeric surface coating may also be chemical resistant.

Embodiments of the flexible polymeric surface coating may comprise one or more of a polyurea, a polyurethane, and a polyester. In some embodiments, for example, the flexible polymeric surface coating may comprise polyurea. For example, the flexible polymer surface coating may be a polyurea spray coating.

The flexible polymer surface coating can be applied to have a desired thickness. For instance, the flexible polymer surface coating may be applied so as to have a thickness between about 1 mm and about 150 mm, alternatively between about 1 mm and about 100 mm, alternatively between about 1 mm and about 75 mm, alternatively between about 1 mm and about 50 mm, alternatively between about 1 mm and about 25 mm, alternatively between about 1 mm and about 15 mm, alternatively between about 1 mm and about 10 mm, alternatively between about 1 mm and about 8 mm, alternatively between about 2 mm and about 10 mm, alternatively between about 2 mm and about 7 mm, alternatively between about 3 mm and about 5 mm. In general, a relatively thin coating, e.g. one to several millimeters, has been found to provide a climbing surface having the desired properties while minimizing material costs.

The flexible polymer surface coating may be provided in any of a variety of different colors, in order to provide a climbing surface having a desired appearance.

In yet other embodiments, one or more of the surface panels 12 may have a surface coating that comprises at least a first layer and a second layer, the first layer comprising a texturing component and the second layer being provided over the first layer. In some embodiments, each of the one or more surface panels 12 that make up the climbing surface 14 may have a surface coating that comprises at least a first layer and a second layer, the first layer comprising a texturing component and the second layer being provided over the first layer.

In some embodiments, the first layer may comprise an aggregate material dispersed in a coating material. The aggregate material may comprise any material that provides the desired texture. In some embodiments, the aggregate material may comprise glass particles, a silica sand, a ceramic powder, a natural granular material such as that formed from organic materials (e.g. crushed walnut shells), or combinations thereof. In some embodiments, the aggregate may comprise glass particles, such as glass beads, crushed glass, or a combination thereof. For example, the aggregate may comprise glass beads. In some embodiments, a substantial percentage, i.e. at least 60%, of the glass beads may be round. Alternatively, the aggregate may be crushed glass, such as crushed recycled glass.

The aggregates may have a variety of particle sizes. One of the scales used to classify particle sizes is US Sieve Size. In some embodiments, the aggregates may have particle sizes with US Sieve Sizes within the range of 20 to 100, alternatively within the range of 25 to 90, alternatively within the range of 30 to 80, alternatively within the range of 40 to 70. For instance, in some embodiments, the aggregates may have particle sizes between about 100 microns and about 900 microns, alternatively between about 150 microns and about 850 microns, alternatively between about 200 microns and about 800 microns, alternatively between about 200 microns and about 600 microns. In some embodiments where crushed glass is used as the aggregate, the crushed glass may have grit sizes between G-14 and G-21.

In some embodiments, the coating material may comprise a paint or a paint primer. A paint or paint primer may consist essentially of synthetic or natural resins, solvents, pigments, and optionally polyethylene for increased durability. The synthetic or natural resins may comprise alkyds, acrylics, vinyl-acrylics, vinyl acetate/ethylene (VAE), polyurethanes, polyesters, melamine resins, epoxy, silanes, or siloxanes.

The amount of aggregate material in the first layer may be selected to provide a desired degree of texture. In some embodiments, the first layer may comprise between about 25 wt. % and about 75 wt. % aggregate, alternatively between about 40 wt. % and about 60 wt. % aggregate. In some embodiments, for example, the first layer may comprise about 50 wt. % aggregate materials and about 50 wt. % coating material.

In some embodiments, the second layer may comprise a non-stick component. For instance, in some embodiments, the second layer may comprise a paint having a non-stick additive. In other embodiments, the resin used in the paint may be selected to provide a non-stick property. The paint may consist essentially of synthetic or natural resins, solvents, and pigments. The synthetic or natural resins may comprise alkyds, acrylics, vinyl-acrylics, vinyl acetate/ethylene (VAE), polyurethanes, polyesters, melamine resins, epoxy, silanes, or siloxanes. In some embodiments, the second layer may comprise an exterior or interior/exterior latex paint.

The second layer is applied over the first layer. Accordingly, the second layer serves to seal the aggregate material within the combined surface coating. For instance, the first layer may be applied to the one or more panels and allowed to dry. Then, the second layer may be applied over the first layer. Each of the first layer and the second layer may be applied by spraying, brushing, dip-coating, or the like. In some embodiments, one or more additional materials, such as primer coatings, may be applied underneath the first layer or between the first layer and the second layer.

The surface coating comprises at least a first layer comprising a texturing component and a second layer covering the first layer and sealing the texturing component in place. This provides for a textured climbing surface in which the texturing component remains on the surface even when subjected to the rigorous stresses the surface coating undergoes during climbing.

Additionally, by providing the second layer with a non-stick component, the surface coating may be configured to prevent damage to the surface coating from the removal and replacement of climbing holds. For instance, when climbing holds are removed from conventional climbing surfaces, conventional surface coatings stick to the climbing hold, leaving behind a shadow or other mark on the climbing surface. Thus, when the plurality of climbing holds are re-arranged and/or replaced, the positions of the prior arrangement of climbing holds may remain visible on the surface of the climbing wall, which provides a disfavored appearance. By using embodiments of the surface coating disclosed herein, the plurality of climbing holds may be removed from the climbing surface without leaving any undesirable markings on the surface coating.

Although the connectors 30; adjustable braces 50; integral, variable-angle front posts 70; and surface panels 80 are all described separately, it should be understood that each of these components can be used alone or in combination with any of the other components disclosed herein. The various combinations of components 30, 50, 70, 80 provide benefits beyond those achieved by each component alone.

Figure 22:
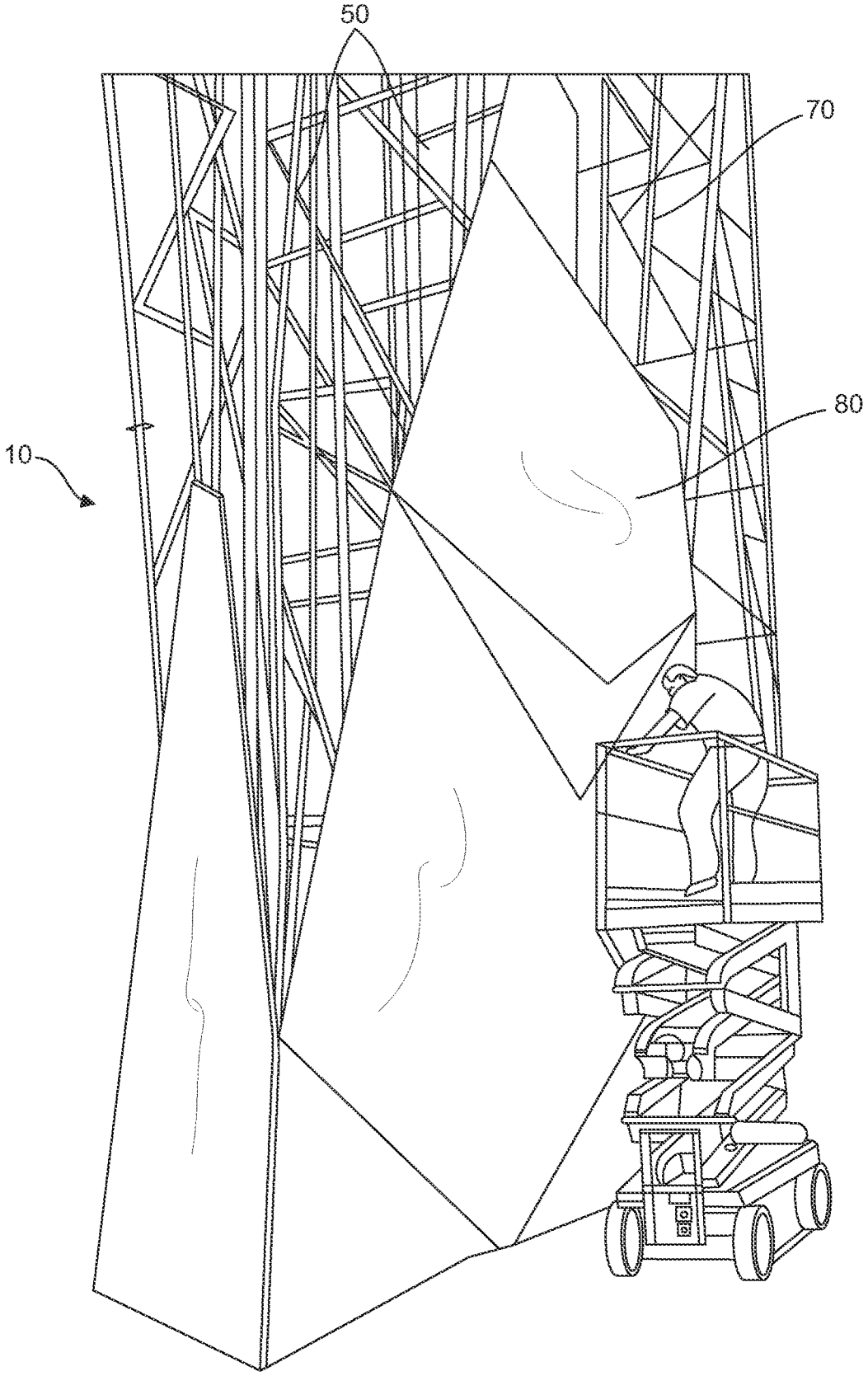
FIG. 22 is a front perspective view of a climbing wall under construction using embodiments of the components described herein.
Figure 23:
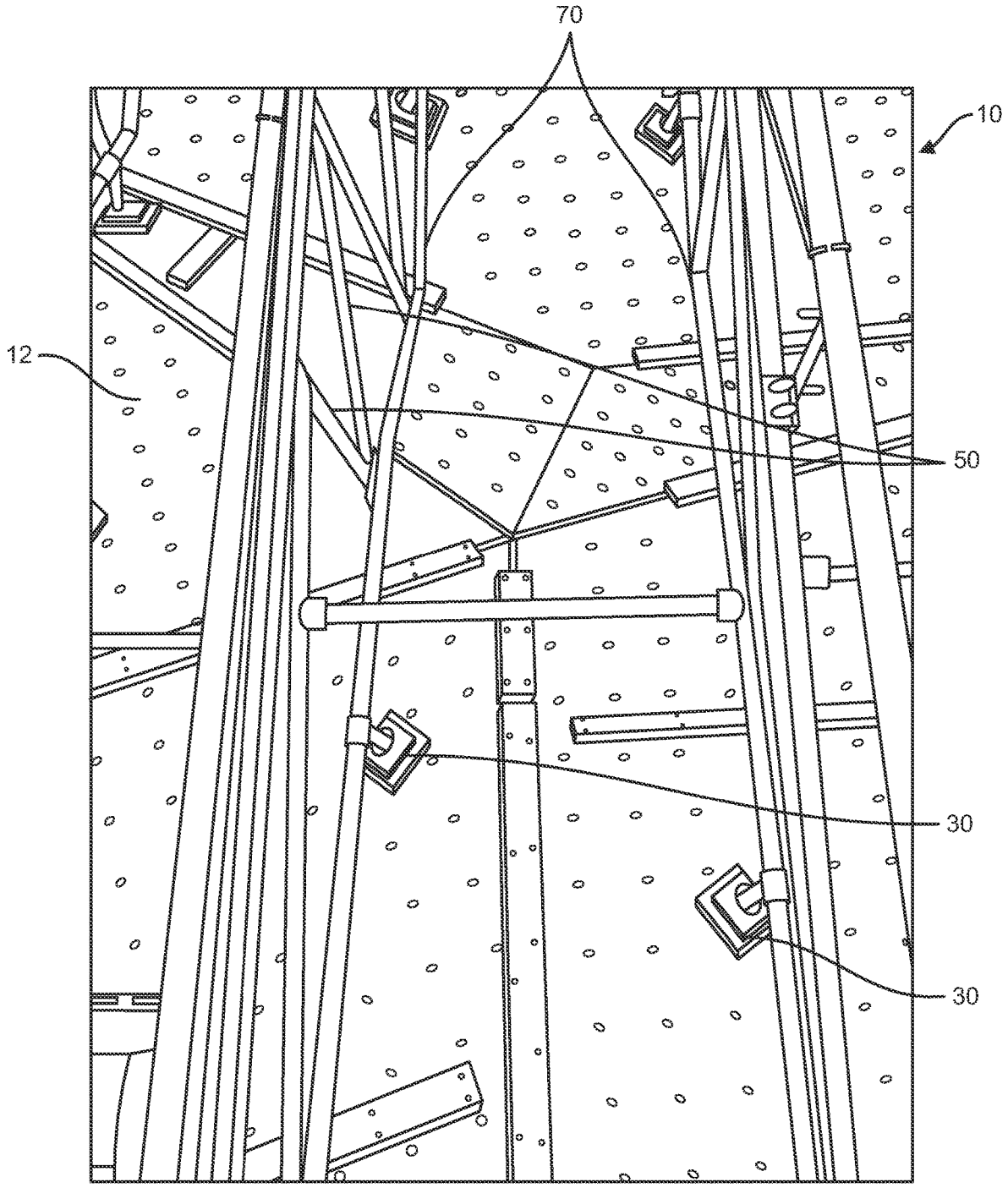
FIG. 23 is a rear perspective view of a climbing wall under construction using embodiments of the components described herein.

An example of a climbing wall 10 constructed using embodiments of the connectors 30; adjustable braces 50; integral, variable-angle front posts 70; and surface panels 80 described herein is shown in FIGS. 22 and 23.

It can be seen that the described embodiments provide a unique and novel climbing wall 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A climbing wall comprising:

a framework;

one or more surface panels affixed to the framework, each of the one or more surface panels having a front face; and a plurality of climbing holds arranged along the front face(s) of the one or more surface panels;

wherein the front face of at least one of the one or more surface panels comprises a flexible polymeric surface coating, wherein the flexible polymer surface coating has a shore A hardness of 90 or less.

2. The climbing wall of claim 1, wherein the flexible polymeric surface coating is sprayed onto the front face(s) of the one or more surface panels.

3. The climbing wall of claim 1, wherein the flexible polymeric surface coating has a weight loss of less than 400 mg after 1000 cycles of Taber abrasion testing under ASTM D 4060.

4. The climbing wall of claim 3, wherein the flexible polymeric surface coating has a weight loss of less than 200 mg after 1000 cycles of Taber abrasion testing under ASTM D 4060.

5. The climbing wall of claim 1, wherein the flexible polymeric surface coating is water resistant.

6. The climbing wall of claim 1, wherein the flexible polymeric surface coating comprises one or more of a polyurea, a polyurethane, and a polyester.

7. The climbing wall of claim 6, wherein the flexible polymeric surface coating comprises polyurea.

8. The climbing wall of claim 7, wherein the flexible polymeric surface coating is a polyurea spray coating.

9. The climbing wall of claim 1, wherein the flexible polymeric surface coating has a thickness between about 1 mm and about 10 mm.

10. The climbing wall of claim 1, wherein the flexible polymeric surface coating conceals scratches to the surface of the coating.

11. The climbing wall of claim 10, wherein a scratch having a thickness of 0.5 mm or less is not visible on the surface of the coating.

12. The climbing wall of claim 1, wherein the flexible polymeric surface coating is elastomeric.

13. The climbing wall of claim 1, wherein the flexible polymeric surface coating prevents rotation of the climbing holds about the front face of the surface panel.

14. The climbing wall of claim 1, in which the front face of each of the one or more surface panels comprises the flexible polymeric surface coating.

15. A climbing wall comprising:

a framework;

one or more surface panels affixed to the framework, each of the one or more surface panels having a front face; and a plurality of climbing holds arranged along the front face(s) of the one or more surface panels;

wherein the front face of at least one of the one or more surface panels comprises a flexible polymeric surface coating, wherein the flexible polymeric surface coating has a Shore A hardness of 90 or less; and wherein the flexible polymeric surface coating is a polyurea coating having a thickness between about 1 mm and about 100 mm.

16. The climbing wall of claim 15, wherein the polyurea coating is a polyurea spray coating.

17. The climbing wall of claim 15, wherein the flexible polymeric surface coating has a Shore A hardness of 80 or less.

18. The climbing wall of claim 15, wherein the flexible polymeric surface coating has a thickness between about 1 mm and about 10 mm.

19. The climbing wall of claim 15, in which the front face of each of the one or more surface panels comprises the flexible polymeric surface coating.

* * * * *